US011176867B2

(12) United States Patent
Yang et al.

(10) Patent No.: US 11,176,867 B2
(45) Date of Patent: Nov. 16, 2021

(54) CHROMA COMPENSATION METHOD AND APPARATUS, DEVICE, DISPLAY DEVICE AND STORAGE MEDIUM

(71) Applicant: BOE Technology Group Co., Ltd., Beijing (CN)

(72) Inventors: Fei Yang, Beijing (CN); Mingi Chu, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 41 days.

(21) Appl. No.: 16/620,134

(22) PCT Filed: Apr. 15, 2019

(86) PCT No.: PCT/CN2019/082770

§ 371 (c)(1),
(2) Date: Dec. 6, 2019

(87) PCT Pub. No.: WO2019/201220

PCT Pub. Date: Oct. 24, 2019

(65) Prior Publication Data

US 2021/0150963 A1 May 20, 2021

(30) Foreign Application Priority Data

Apr. 17, 2018 (CN) ..... 201810345229.7

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2300/0452* (2013.01);
(Continued)

(58) Field of Classification Search
CPC ..... G09G 3/2003; G09G 3/3208; G09G 2300/0452; G09G 2320/0242; G09G 2320/0666
See application file for complete search history.

(56) References Cited

U.S. PATENT DOCUMENTS 6,091,397 A 7/2000 Lee
7,425,964 B2 9/2008 Chen et al.
(Continued)

FOREIGN PATENT DOCUMENTS

CN 1748241 A 3/2006
CN 101271939 A 9/2008
(Continued)

OTHER PUBLICATIONS

International search report of PCT application No. PCT/CN2019/082770 dated Jun. 27, 2019.
(Continued)

*Primary Examiner* — Stephen G Sherman
(74) *Attorney, Agent, or Firm* — Fay Sharpe LLP

(57) ABSTRACT

Disclosed are a chroma compensation method and apparatus, a display device and a storage medium. The chroma compensation method includes: acquiring an initial color of a display sub-pixel in a target pixel unit under a target luminance, and a target color of the target pixel unit under the target luminance, the target pixel unit including: at least two display sub-pixels of different light colors; acquiring a complementary color gain of each of the display sub-pixels under the target luminance based on the target color and the initial color of each of the display sub-pixels; and compensating for chrominance of the target pixel unit based on the complementary color gain of each of the display sub-pixels under the target luminance.

20 Claims, 17 Drawing Sheets

(52) U.S. Cl.
CPC ..... *G09G 2320/0242* (2013.01); *G09G 2320/0666* (2013.01)

(56) References Cited

U.S. PATENT DOCUMENTS

| | | | | |
|---|---|---|---|---|
| 2006/0139368 | A1 | 6/2006 | Kinoshita et al. | |
| 2006/0256053 | A1* | 11/2006 | Baek | G09G 3/3607 345/88 |
| 2006/0284805 | A1* | 12/2006 | Baek | G09G 3/3607 345/88 |
| 2007/0211176 | A1 | 9/2007 | Hsu et al. | |
| 2014/0267785 | A1 | 9/2014 | Chen et al. | |
| 2015/0009228 | A1* | 1/2015 | Chen | G09G 5/10 345/601 |
| 2016/0027360 | A1* | 1/2016 | Li | G09G 3/2003 345/690 |
| 2016/0253942 | A1 | 9/2016 | Tseng et al. | |
| 2017/0039991 | A1 | 2/2017 | Zhao et al. | |
| 2017/0345377 | A1* | 11/2017 | Oh | G09G 3/3291 |
| 2019/0027081 | A1 | 1/2019 | Han et al. | |
| 2019/0122607 | A1 | 4/2019 | Yan | |
| 2019/0237009 | A1 | 8/2019 | Chu | |

FOREIGN PATENT DOCUMENTS

| | | | |
|---|---|---|---|
| CN | 103366709 | A | 10/2013 |
| CN | 104269138 | A | 1/2015 |
| CN | 105100763 | A | 11/2015 |
| CN | 105405389 | A | 3/2016 |
| CN | 105989800 | A | 10/2016 |
| CN | 107146574 | A | 9/2017 |
| CN | 107248389 | A | 10/2017 |
| CN | 107316609 | A | 11/2017 |
| CN | 107784975 | A | 3/2018 |
| CN | 108520717 | A | 9/2018 |
| EP | 1843602 | A2 | 10/2007 |

OTHER PUBLICATIONS

First office action of Chinese application No. 201810345229.7 dated Jul. 3, 2019.

Examination report of Indian application No. 201937050951 dated Feb. 26, 2021.

Notice of allowance of Korean application No. 10-2019-7037689 dated Apr. 5, 2021.

* cited by examiner

CHROMA COMPENSATION METHOD AND APPARATUS, DEVICE, DISPLAY DEVICE AND STORAGE MEDIUM

This application is a 371 application of PCT international application No.: PCT/CN2019/082770 filed on Apr. 15, 2019, claims priority to Chinese Patent Application No. 201810345229.7, filed on Apr. 17, 2018 and entitled "CHROMA COMPENSATION METHOD AND APPARATUS, DEVICE, DISPLAY DEVICE AND STORAGE MEDIUM", the entire contents of which are incorporated herein by reference.

TECHNICAL FIELD

The present disclosure relates to the field of display technologies, and more particularly, relates to a chroma compensation method and apparatus, a device, a display device and a storage medium

BACKGROUND

An organic light-emitting diode (OLED), as a current-type light-emitting device, has been increasingly used in high-performance display devices, and in order to improve the luminous efficiency of OLED display devices, a new RGBW OLED display device consisting of red (R) sub-pixels, green (G) sub-pixels, blue (B) sub-pixels, and white (W) sub-pixels has emerged, wherein the color of the W sub-pixels is determined based on the color of the R sub-pixels, the color of the G sub-pixels, and the color of the B sub-pixels.

SUMMARY

The present disclosure provides a chroma compensation method and apparatus, a device, a display device and a storage medium. The technical solutions are as follows:

In one aspect, a chroma compensation method is provided. The method includes:

acquiring an initial color of a display sub-pixel in a target pixel unit under a target luminance, and a target color of the target pixel unit under the target luminance, the target pixel unit including: at least two display sub-pixels of different light colors;

acquiring a complementary color gain of each of the display sub-pixels under the target luminance based on the target color and the initial color of each of the display sub-pixels; and compensating for chrominance of the target pixel unit based on the complementary color gain of each of the display sub-pixels under the target luminance;

wherein the complementary color gain of any of the display sub-pixels under the target luminance is used to represent a degree to which the any of the display sub-pixels needs to be compensated when the color of the target pixel unit is compensated from the initial color to the target color under the target luminance.

Optionally, the acquiring a complementary color gain of each of the display sub-pixels under the target luminance based on the target color and the initial color of each of the display sub-pixels includes:

querying a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of any of the display sub-pixels by which the target pixel unit is compensated from the initial color to the target color under different luminances.

Optionally, prior to the querying a corresponding relationship between the luminance and the complementary color gain of any of the display sub-pixels to determine the complementary color gain of any of the display sub-pixels under the target luminance based on the target color and the initial color of any of the display sub-pixels, the method further includes:

acquiring a complementary color gain of each of the display sub-pixels at a plurality of reference luminances based on the target color and the initial color of each of the display sub-pixels; and establishing a corresponding relationship between the luminance and the complementary color gain of each of the display sub-pixels under the target color and the initial color of each of the display sub-pixels.

Optionally, the acquiring a complementary color gain of each of the display sub-pixels includes:

determining, at a first luminance, a first initial color of the target pixel unit based on an initial color of the at least two display sub-pixels, the first luminance being any one of the plurality of reference luminances;

acquiring, based on the first initial color and the initial color of the at least two display sub-pixels, a first substitution proportion of an initial color of each of the display sub-pixels with respect to the first initial color, the first substitution proportion being a proportion of the initial color of each of the display sub-pixels in the first initial color;

acquiring, based on the target color and the initial color of the at least two display sub-pixels, a second substitution proportion of an initial color of each of the display sub-pixels with respect to the target color, the second substitution proportion being a proportion of the initial color of each of the display sub-pixels in the target color;

determining, based on the first substitution proportion and the second substitution proportion, a first complementary color coefficient of the first initial color under the first luminance and a second complementary color coefficient of the target color under the first luminance respectively, the first complementary color coefficient being used to represent a degree of chrominance compensation that needs to be performed when acquiring the first initial color, and the second complementary color coefficient being used to represent a degree of chrominance compensation that needs to be performed when acquiring the target color; and determining a complementary color gain of each of the display sub-pixels under the first luminance based on the first complementary color coefficient and the second complementary color coefficient.

Optionally, the at least two display sub-pixels include a first sub-pixel, a second sub-pixel, and a third sub-pixel; when colors of the sub-pixels are represented by color coordinates, the $j^{th}$ substitution proportion $R_{Wj1}$ corresponding to the first sub-pixel, the $j^{th}$ substitution proportion $R_{Wj2}$ corresponding to the second sub-pixel, and the $j^{th}$ substitution proportion $R_{Wj3}$ corresponding to the third sub-pixel satisfy:

$$R_{Wj1} = \left( \frac{\left( \frac{W_{jX} - R_X}{G_X - R_X} - \frac{W_{jZ} - R_Z}{G_Z - R_Z} \right) \Big/ W_{jY}}{\frac{B_X - R_X}{G_X - R_X} - \frac{B_Z - R_Z}{G_Z - R_Z}} \right) \times R_Y$$

-continued $$R_{Wj2} = \left( \frac{W_{jX} - R_X}{W_{jY} \times (G_X - R_X)} - R_{W11} \times \frac{B_X - R_X}{G_X - R_X} \right) \times G_Y$$

$$R_{Wj3} = \left( \frac{1}{W_{jY}} - R_{W11} - R_{W12} \right) \times B_Y,$$

where j is 1 or 2, the color coordinates of the initial color of the first sub-pixel are ($B_X$, $B_Y$), and the color coordinates of the initial color of the second sub-pixel are ($G_X$, $G_Y$), the color coordinates of the initial color of the third sub-pixel are ($R_X$, $R_Y$), the color coordinates of the first initial color are ($W_{1X}$, $W_{1Y}$), the color coordinates of the target color are ($W_{2X}$, $W_{2Y}$), and $R_Z=1-R_X-R_Y$, $G_Z=1-G_X-G_Y$, $B_Z=1-B_X-B_Y$, $W_{1Z}=1-W_{1X}-W_{1Y}$, $W_{2Z}=1-W_{2X}-W_{2Y}$.

Optionally, when the colors of the sub-pixels are represented by color coordinates, the determining, based on the first substitution proportion and the second substitution proportion, a first complementary color coefficient of the first initial color under the first luminance and a second complementary color coefficient of the target color under the first luminance respectively includes:

acquiring relative positions of the color coordinates of the first initial color and the target color in a color coordinate system;

determining, based on the relative positions, a dominant color component that causes the first initial color to deviate from the target color, the dominant color component being a color component having the largest proportion in the color component that cause the first initial color to deviate from the target color;

determining the first substitution proportion of a sub-pixel whose light color is the dominant color component as the first complementary color coefficient; and determining the second substitution proportion of a sub-pixel whose light color is the dominant color component as the second complementary color coefficient.

Optionally, the at least two display sub-pixels include a first sub-pixel, a second sub-pixel, and a third sub-pixel; and the determining, based on the relative positions, a dominant color component that causes the first initial color to deviate from the target color include:

determining the light color of the second sub-pixel as the dominant color component when the color coordinates ($W_{1X}$, $W_{1Y}$) of the first initial color and the color coordinates ($W_{2X}$, $W_{2Y}$) of the target color satisfy: $W_{1Y} \geq W_{2Y}$;

determining the light color of the third sub-pixel as the dominant color component when the color coordinates ($W_{1X}$, $W_{1Y}$) of the first initial color and the color coordinates ($W_{2X}$, $W_{2Y}$) of the target color satisfy: $W_{1X} \geq W_{2X}$ and $W_{1Y} < W_{2Y}$; and determining the light color of the first sub-pixel as the dominant color component when the color coordinates ($W_{1X}$, $W_{1Y}$) of the first initial color and the color coordinates ($W_{2X}$, $W_{2Y}$) of the target color satisfy: $W_{1X} < W_{2X}$ and $W_{1Y} < W_{2Y}$.

Optionally, the first complementary color coefficient $R_{W1}$, the second complementary color coefficient $R_{W2}$, and the complementary color gain $G_i$ of an $i^{th}$ sub-pixel under the first luminance satisfy:

$$G_i = \left( 1 - \frac{\frac{R_{W2i}}{R_{W2}} - \frac{R_{W1i}}{R_{W1}}}{\frac{R_{W2i}}{R_{W2}}} \right) \times (2^n - 1),$$

where $R_{W2i}$ is a second substitution proportion corresponding to the $i^{th}$ sub-pixel, $R_{W1i}$ is a first substitution proportion corresponding to the $i^{th}$ sub-pixel, n is the number of bits of the drive output signal provided for the sub-pixel, and the drive output signal is used to drive the sub-pixel to emit light.

Optionally, the querying a corresponding relationship between the luminance and the complementary color gain of any of the display sub-pixels to determine the complementary color gain of any of the display sub-pixels under the target luminance based on the target color and the initial color of any of the display sub-pixels, includes:

querying the corresponding relationship according to the target luminance;

determining a complementary color gain corresponding to the target luminance as a complementary color gain of any of the display sub-pixels under the target luminance when the target luminance is recorded in the corresponding relationship;

determining a first candidate luminance and a second candidate luminance among the plurality of luminances recorded in the corresponding relationship when the target luminance is not recorded in the corresponding relationship, wherein the first candidate luminance is one of the plurality of luminance that is weaker than the target luminance and has a smallest luminance difference over the target luminance, and the second candidate luminance is one of the plurality of luminances that is stronger than the target luminance and has the smallest luminance difference over the target luminance; and determining the complementary color gain of any of the display sub-pixels under the target luminance according to a linear interpolation method, based on the target luminance, the first candidate luminance, the second candidate luminance, the complementary color gain corresponding to the first candidate luminance, and the complementary color gain corresponding to the second candidate luminance.

Optionally, the compensating for chrominance of the target pixel unit based on the complementary color gain of each of the display sub-pixels under the target luminance includes:

determining a drive output signal provided for any of the display sub-pixels based on a complementary color gain of any of the display sub-pixels under the target luminance, the drive output signal being configured for driving the sub-pixel to emit light; and providing the drive output signal for any of the display sub-pixels for compensating for chrominance of the target pixel unit.

In another aspect, a chroma compensation apparatus is provided. The apparatus includes:

a first acquiring module, configured to acquire an initial color of a display sub-pixel in a target pixel unit at a target luminance, and a target color of the target pixel unit under the target luminance, the target pixel unit including: at least two display sub-pixels of different light colors;

a second acquiring module, configured to acquire a complementary color gain of each of the display sub-pixels under the target luminance based on the target color and an initial color of each of the display sub-pixels;

a compensating module, configured to compensate for chrominance of the target pixel unit based on a complementary color gain of each of the display sub-pixels under the target luminance;

wherein the complementary color gain of any of the display sub-pixels under the target luminance is used to represent a degree to which the any of the display sub-pixels needs to be compensated when the color of the target pixel unit is compensated from the initial color to the target color under the target luminance.

Optionally, the second acquiring module is configured to query a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of the any of the display sub-pixels by which the target pixel unit is compensated from the initial color to the target color under different luminances.

Optionally, the second acquiring module is further configured to acquire a complementary color gain of each of the display sub-pixels at a plurality of reference luminances based on the target color and the initial color of each of the display sub-pixels; and the apparatus further includes an establishing module for establishing a corresponding relationship between the luminance and the complementary color gain of each of the display sub-pixels under the target color and the initial color of each of the display sub-pixels.

Optionally, the second acquiring module includes:

a first determining sub-module, configured to determine, at a first luminance, a first initial color of the target pixel unit based on an initial color of the at least two display sub-pixels, the first luminance being any one of the plurality of reference luminances;

a first acquiring sub-module, configured to acquire, based on the first initial color and the initial color of the at least two display sub-pixels, a first substitution proportion of an initial color of each of the display sub-pixels with respect to the first initial color, the first substitution proportion being a proportion of the initial color of each of the display sub-pixels in the first initial color;

a second acquiring sub-module, configured to acquire, based on the target color and an initial color of the at least two display sub-pixels, a second substitution proportion of an initial color of each of the display sub-pixels with respect to the target color, the second substitution proportion being a proportion of the initial color of each of the display sub-pixels in the target color;

a second determining sub-module, configured to determine, based on the first substitution proportion and the second substitution proportion, a first complementary color coefficient of the first initial color under the first luminance and a second complementary color coefficient of the target color under the first luminance respectively, the first complementary color coefficient being used to represent a degree of chrominance compensation that needs to be performed when acquiring the first initial color, and the second complementary color coefficient being used to represent a degree of chrominance compensation that needs to be performed when acquiring the target color;

a third determining sub-module, configured to determine a complementary color gain of each of the display sub-pixels under the first luminance based on the first complementary color coefficient and the second complementary color coefficient.

Optionally, the at least two display sub-pixels include a first sub-pixel, a second sub-pixel, and a third sub-pixel; when colors of the sub-pixels are represented by color coordinates, a $j^{th}$ substitution proportion $R_{Wj1}$ corresponding to the first sub-pixel, a $j^{th}$ substitution proportion $R_{Wj2}$ corresponding to the second sub-pixel, and a $j^{th}$ substitution proportion $R_{Wj3}$ corresponding to the third sub-pixel satisfy:

$$R_{Wj1} = \left( \frac{\left( \frac{W_{jX} - R_X}{G_X - R_X} - \frac{W_{jZ} - R_Z}{G_Z - R_Z} \right) \Big/ W_{jY}}{\frac{B_X - R_X}{G_X - R_X} - \frac{B_Z - R_Z}{G_Z - R_Z}} \right) \times R_Y$$

$$R_{Wj2} = \left( \frac{W_{jX} - R_X}{W_{jY} \times (G_X - R_X)} - R_{W11} \times \frac{B_X - R_X}{G_X - R_X} \right) \times G_Y$$

$$R_{Wj3} = \left( \frac{1}{W_{jY}} - R_{W11} - R_{W12} \right) \times B_Y,$$

where j is 1 or 2, the color coordinates of an initial color of the first sub-pixel are $(B_X, B_Y)$, the color coordinates of an initial color of the second sub-pixel are $(G_X, G_Y)$, the color coordinates of an initial color of the third sub-pixel are $(R_X, R_Y)$, the color coordinates of the first initial color are $(W_{1X}, W_{1Y})$, the color coordinates of the target color are $(W_{2X}, W_{2Y})$, and $R_Z=1-R_X-R_Y$, $G_Z=1-G_X-G_Y$, $B_Z=1-B_X-B_Y$, $W_{1Z}=1-W_{1X}-W_{1Y}$, $W_{2Z}=1-W_{2X}-W_{2Y}$.

Optionally, when the colors of the sub-pixels are represented by color coordinates, the second determining sub-module is configured to:

acquire relative positions of the color coordinates of the first initial color and the target color in a color coordinate system;

determine, based on the relative positions, a dominant color component that causes the first initial color to deviate from the target color, the dominant color component being a color component having the largest proportion in the color component that cause the first initial color to deviate from the target color;

determine the first substitution proportion of a sub-pixel whose light color is the dominant color component as the first complementary color coefficient;

determine the second substitution proportion of a sub-pixel whose light color is the dominant color component as the second complementary color coefficient.

Optionally, the at least two display sub-pixels include a first sub-pixel, a second sub-pixel, and a third sub-pixel; and the second determining sub-module is configured to:

determine the light color of the second sub-pixel as the dominant color component when the color coordinates $(W_{1X}, W_{1Y})$ of the first initial color and the color coordinates $(W_{2X}, W_{2Y})$ of the target color satisfy: $W_{1Y} \geq W_{2Y}$;

determine the light color of the third sub-pixel as the dominant color component when the color coordinates $(W_{1X}, W_{1Y})$ of the first initial color and the color coordinates $(W_{2X}, W_{2Y})$ of the target color satisfy. $W_{1X} \geq W_{2X}$ and $W_{1Y} < W_{2Y}$;

determine the light color of the first sub-pixel as the dominant color component when the color coordinates $(W_{1X}, W_{1Y})$ of the first initial color and the color coordinates $(W_{2X}, W_{2Y})$ of the target color satisfy: $W_{1X} < W_{2X}$ and $W_{1Y} < W_{2Y}$.

In still another aspect, a display device is provided. The display device includes: a chroma compensation apparatus. The chroma compensation apparatus includes a first acquiring module, configured to acquire an initial color of a display sub-pixel in a target pixel unit at a target luminance, and a target color of the target pixel unit under the target luminance, the target pixel unit including: at least two display sub-pixels of different light colors;

a second acquiring module, configured to acquire a complementary color gain of each of the display sub-pixels under the target luminance based on the target color and an initial color of each of the display sub-pixels;

a compensating module, configured to compensate for chrominance of the target pixel unit based on a complementary color gain of each of the display sub-pixels under the target luminance;

wherein the complementary color gain of any of the display sub-pixels under the target luminance is used to represent a degree to which the any of the display sub-pixels needs to be compensated when the color of the target pixel unit is compensated from the initial color to the target color under the target luminance.

In still yet another aspect, a device for use in chroma compensation is provided. The device includes:

a processor; and a memory;

wherein the memory stores at least one program configured to be executed by the processor, and when executed by the processor, capable of implementing the chroma compensation method according to any one of the above aspects.

In yet another aspect of the present disclosure, a storage medium having stored therein a computer program is provided. The computer program, when being executed by a processor, performs the chroma compensation method according to any one of the above aspects.

BRIEF DESCRIPTION OF THE DRAWINGS

For clearer descriptions of the technical solutions in the embodiments of the present disclosure, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION OF THE PREFERRED EMBODIMENTS

The embodiments of the present disclosure are described in further detail with reference to the accompanying drawings, to present the principles and advantages of the present disclosure more clearly.

Generally, in an RGBW OLED display device, the color of the W sub-pixel is determined according to the color of the R sub-pixel, the color of the G sub-pixel, and the color of the B sub-pixel based on the theory of colorimetry, and the color shown by the display panel is a mixed color of the color displayed by the R sub-pixel, the color displayed by the G sub-pixel and the color displayed by the B sub-pixel. However, in different application scenarios, there are different requirements for the final color shown by the display panel. Therefore, it is also required to perform chrominance compensation on the pixel units in the display panel according to the requirements of different application scenarios, such that the color shown by the display panel satisfies the corresponding application scenario, so as to improve display flexibility of the display panel.

Figure 1:
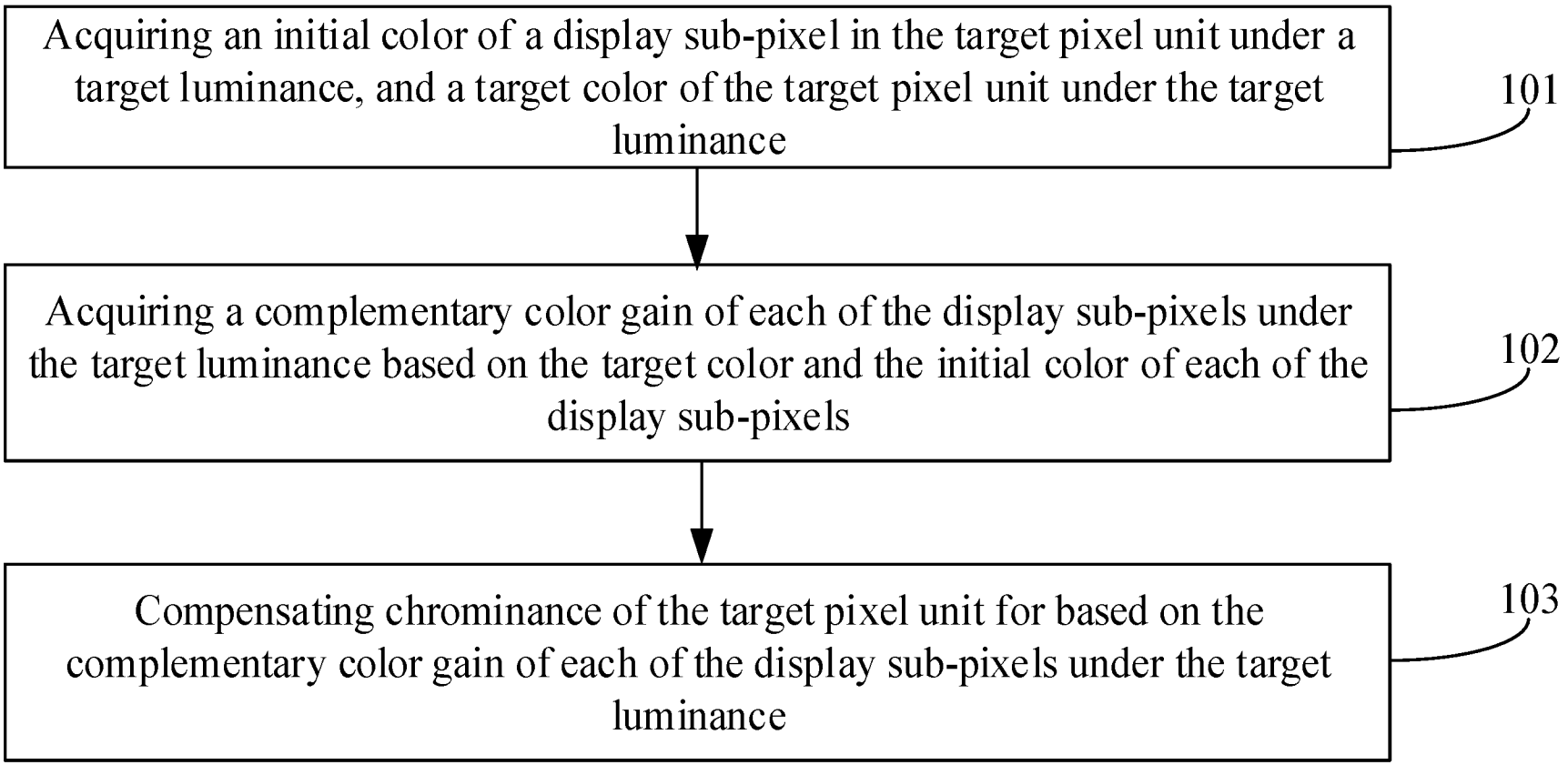
FIG. 1 is a flowchart of a chroma compensation method according to an embodiment of the present disclosure.

Embodiments of the present disclosure provide a chroma compensation method for performing chrominance compensation on a pixel unit in a display panel, wherein the display panel includes a plurality of pixel units, each pixel unit including at least two display sub-pixels of different colors. As shown in FIG. 1, the method may include:

Step 101: An initial color of a display sub-pixel in the target pixel unit under a target luminance, and a target color of the target pixel unit under the target luminance are acquired.

The target pixel unit includes at least two display sub-pixels of different light colors. The initial color is a color shown by the target pixel unit before chroma compensation is performed for the target pixel unit. The initial color is determined by an image to be displayed on the display panel. The target color is a color shown by the target pixel unit after chrominance compensation is performed on the target pixel unit. Alternatively, the target color may be a color determined to be shown by the target pixel unit according to the requirements of the application scenario.

Step 102: A complementary color gain of each of the display sub-pixels under the target luminance is acquired based on the target color and the initial color of each of the display sub-pixels.

Step 103: Chrominance of the target pixel unit is compensated for based on the complementary color gain of each of the display sub-pixels under the target luminance.

The complementary color gain of any of the display sub-pixels under the target luminance is used to represent a degree to which the any of the display sub-pixels needs to be compensated when the color of the target pixel unit is compensated from the initial color to the target color under the target luminance.

Optionally, the compensation gains of any of the display sub-pixels under different luminances for compensating the target pixel unit from the initial color to a target color under the target luminance are different.

In summary, the chroma compensation method according to the embodiments of the present disclosure includes acquiring a complementary color gain of each of the display sub-pixels under the target luminance based on the target color and the initial color of each of the display sub-pixels, and compensating for chrominance of the target pixel unit based on the complementary color gain, and compensating for the color shown by the display panel according to different application scenarios, such that the color shown by the display panel satisfies different application scenarios, thereby improving display flexibility of the display panel and enabling the display panel to be applied to a variety of application scenarios.

In addition, since the compensation gains of any of the display sub-pixels under different luminances for compensating the target pixel unit from the initial color to a target color under the target luminance are different, different chroma compensations may be practiced with respect to different luminances, such that the chroma compensation is refined, and thus the display effect of the display panel is improved.

Figure 2:
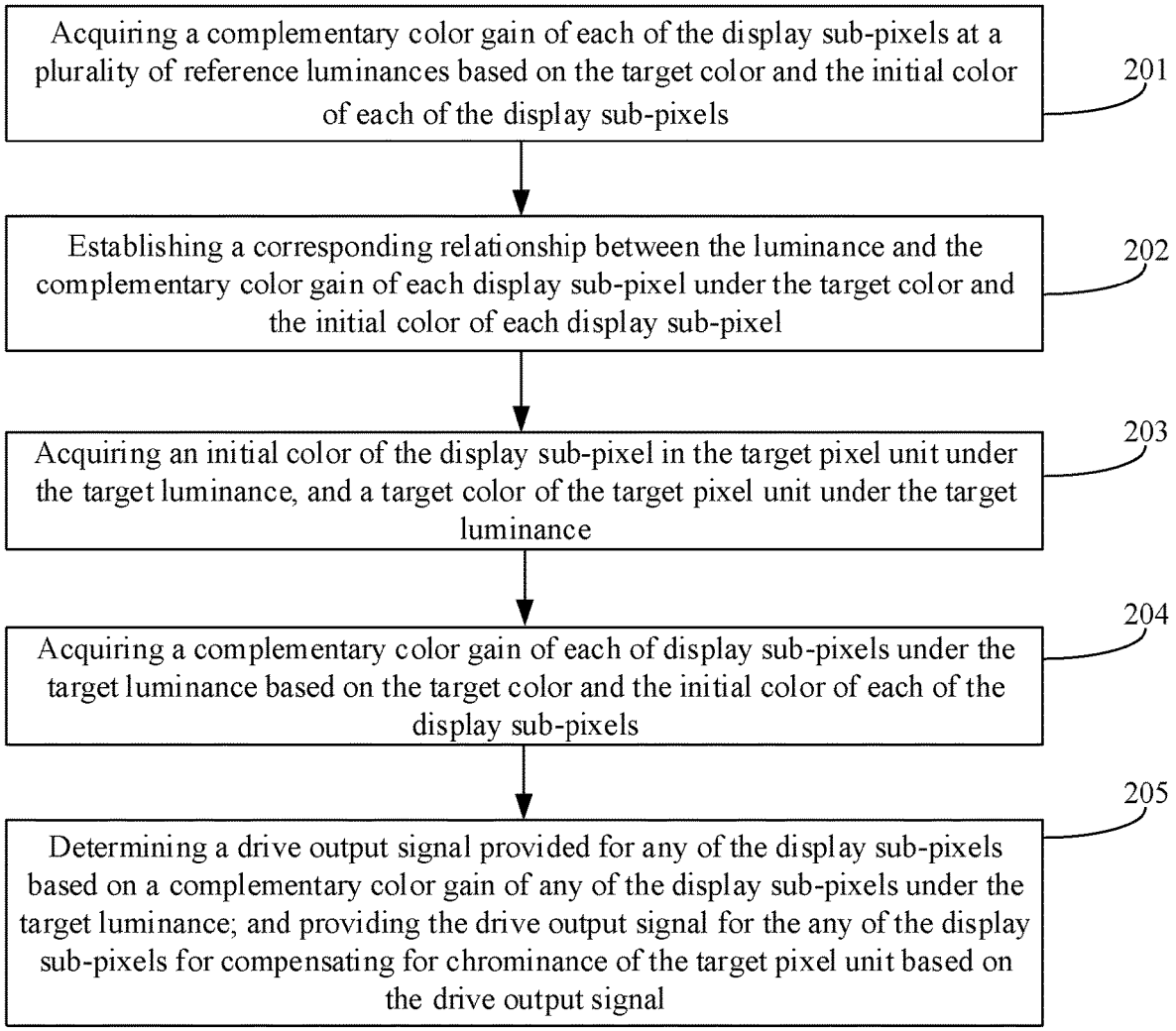
FIG. 2 is a flowchart of another chroma compensation method according to an embodiment of the present disclosure.

Optionally, in the display process of the display panel, the complementary color gain of each of the display sub-pixels may be acquired in real time, and the chrominance compensation is performed on the target pixel unit according to the complementary color gain. Alternatively, the corresponding relationship between the luminance and the complementary color gain of the display sub-pixel may be pre-established, and is queried to obtain the complementary color gain of the display sub-pixel when the complementary color gain of the display sub-pixel needs to be acquired. The chroma compensation method according to the embodiments of the present disclosure will be described below by taking, as an example, the pre-establishment and querying of the corresponding relationship to obtain the complementary color gain of the display sub-pixel. As shown in FIG. 2, the method may include:

Step 201: A complementary color gain of each of the display sub-pixels at a plurality of reference luminances is acquired based on the target color and the initial color of each of the display sub-pixels.

The display panel includes a plurality of pixel units, wherein each pixel unit includes at least two display sub-pixels. In an implementable embodiment, the complementary color gains of all or a part of the plurality of pixel units may be acquired, and a corresponding relationship between the luminance and the complementary color gain is established, so as to obtain the complementary color gain of the display sub-pixel under the target luminance according to the corresponding relationship in the subsequent process of use of the display panel, thereby achieving the chroma compensation for the display panel according to the complementary color gain. For convenience of depiction, the pixel unit, where the display sub-pixel that needs to acquire the complementary color gain is located, is referred to as a reference pixel unit. For example, when the corresponding relationship records the corresponding relationship between the display sub-pixels of different colors in all the pixel units of the display panel and the complementary color gain under different luminances, the complementary color gains of the display sub-pixels in all the pixel units of the display panel need to be acquired, and then the reference pixel unit is any one of all pixel units in the display panel. And the reference pixel unit may be a target pixel unit that needs chrominance compensation in the subsequent chroma compensation process, or may not be the target pixel unit, which is not specifically limited in the embodiment of the present disclosure.

Figure 3:
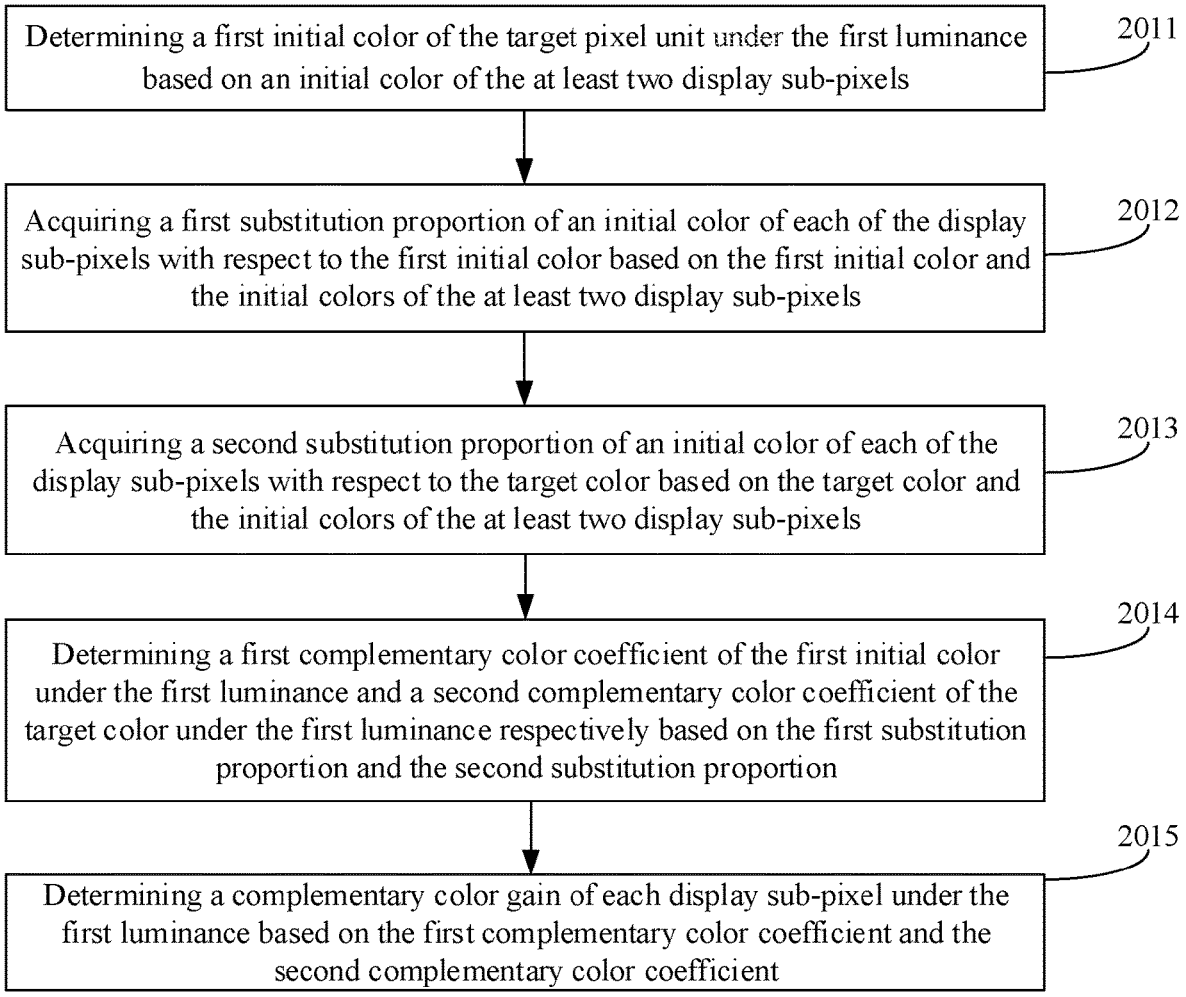
FIG. 3 is a flowchart of a method for acquiring a complementary color gain of each of the display sub-pixels according to an embodiment of the present disclosure.

Optionally, referring to FIG. 3, the acquiring a complementary color gain of each of the display sub-pixels at a plurality of reference luminances based on the target color and the initial color of each of the display sub-pixels may include the following steps. The first luminance is any one of a plurality of reference luminances.

Step 2011: A first initial color of the target pixel unit is determined under the first luminance based on an initial color of the at least two display sub-pixels.

The initial colors of respective display sub-pixels may be colors stored in a memory of the display device. The initial colors may be measured by an optical instrument and stored in the memory during display of the display panel. Moreover, since the color of the pixel unit is obtained by mixing the colors of the respective display sub-pixels in the pixel unit, the first initial color of the reference pixel unit may be determined according to the initial color of each display sub-pixel based on the theory of colorimetry.

Figure 4:
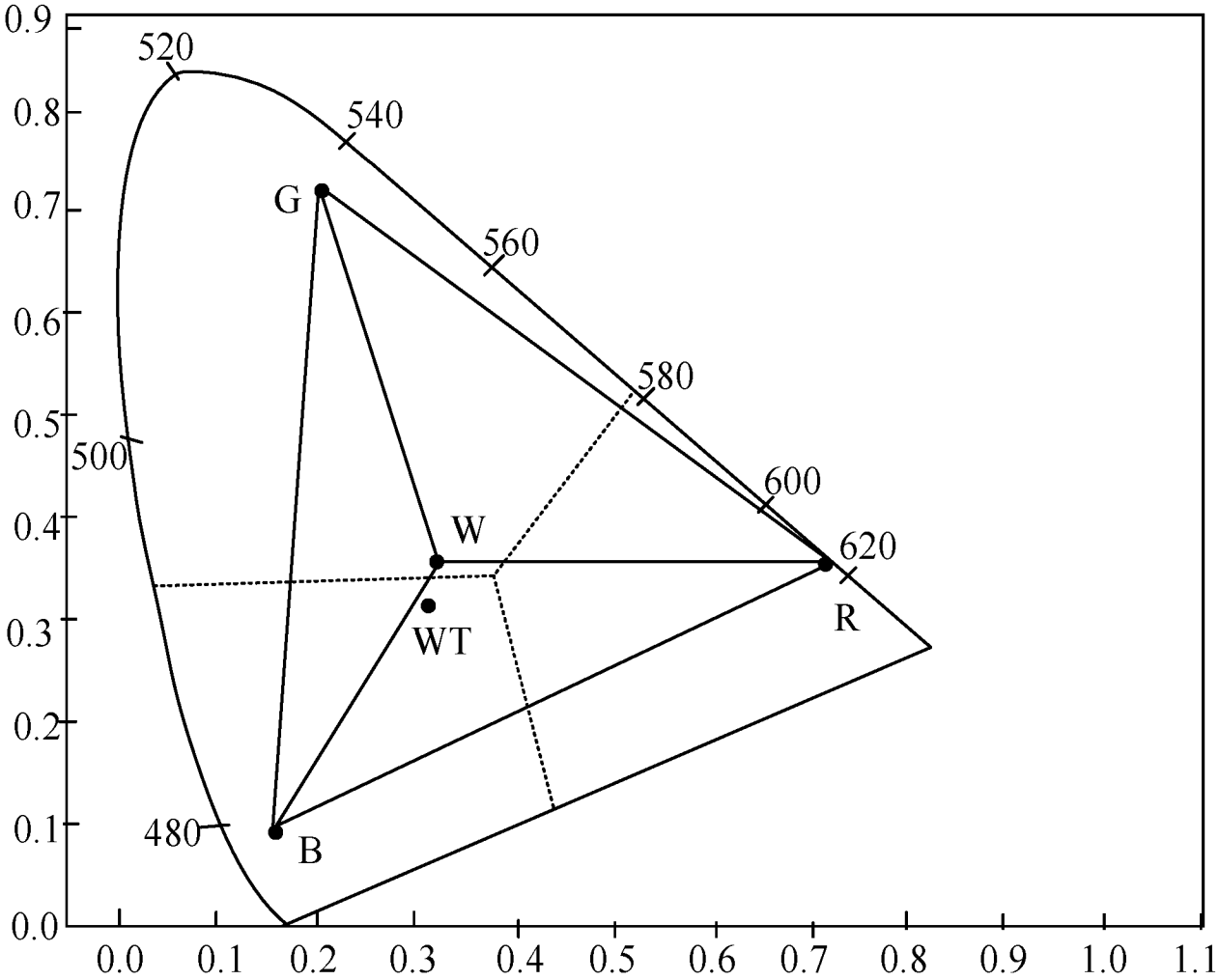
FIG. 4 is a schematic diagram of color coordinates of an R sub-pixel, a G sub-pixel, a B sub-pixel, and a W sub-pixel according to an embodiment of the present disclosure.

Exemplarily, it is assumed that at least two display sub-pixels include: R sub-pixels, G sub-pixels, and B sub-pixels, with reference to FIG. 4, when colors are represented by color coordinates, the position of the color coordinates in the color coordinate system determined according to the initial color of each display sub-pixel is shown in FIG. 4, and based on the theory of colorimetry, the first initial color of the reference pixel unit may be determined according to the initial colors of the R sub-pixel, the G sub-pixel and the B sub-pixel, and the color coordinate position corresponding to the first initial color is shown by W in FIG. 4, and it may be seen from FIG. 4 that the position of the color coordinates of the reference pixel unit is located inside the triangle enclosed by the R sub-pixel, the G sub-pixel, and the B sub-pixel.

Figure 5:
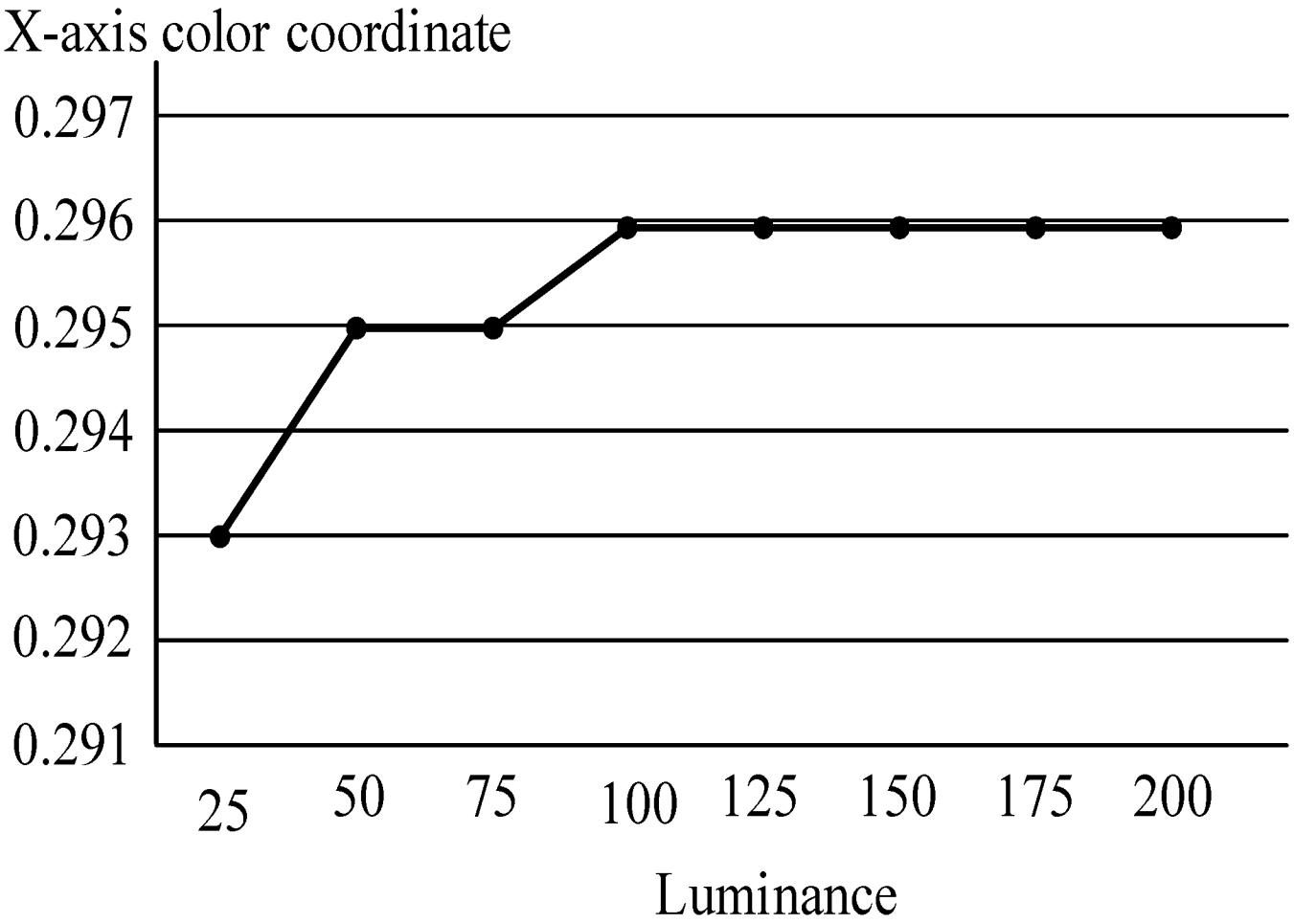
FIG. 5 is a schematic diagram of X-axis color coordinates of a W sub-pixel varying with luminance according to an embodiment of the present disclosure.
Figure 6:
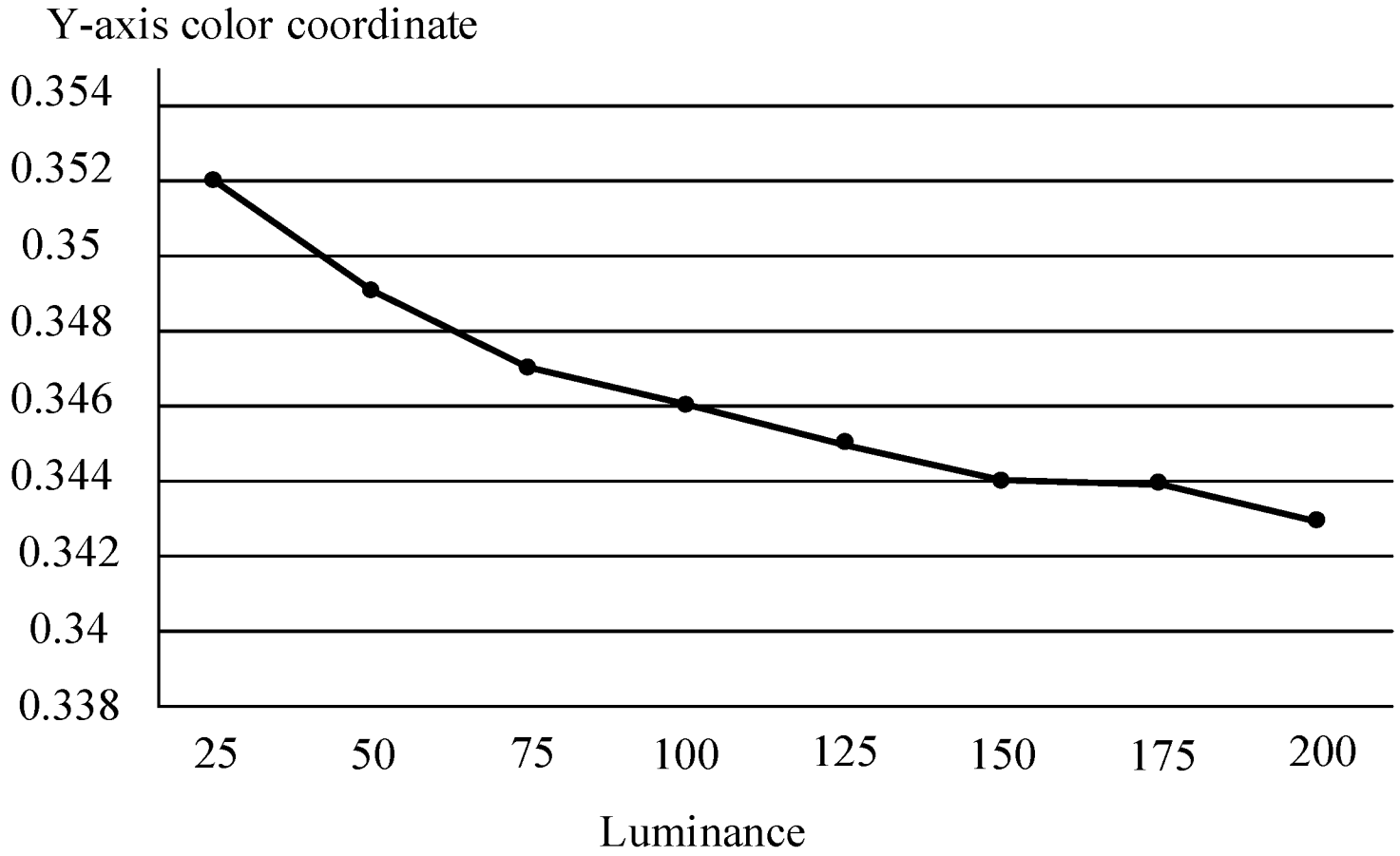
FIG. 6 is a schematic diagram of Y-axis color coordinates of a W sub-pixel varying with luminance according to an embodiment of the present disclosure.

Further, the luminance may affect the color coordinates, and when the luminance varies and other components of the color do not vary, the color coordinates vary accordingly. Exemplarily, FIG. 5 and FIG. 6 are schematic diagrams of the X-axis color coordinates and the Y-axis color coordinates of the pixel unit varying with luminance, and it may be seen from FIG. 5 and FIG. 6 that the color coordinates of the pixel unit are different under different luminances, and the situations of the x-axis color coordinates and the y-axis color coordinates varying with luminance are different. Therefore, it is necessary to determine the complementary color gain of each display sub-pixel according to different luminances.

Step 2012: A first substitution proportion of an initial color of each of the display sub-pixels with respect to the first initial color is acquired based on the first initial color and the initial colors of the at least two display sub-pixels.

The first substitution proportion is a proportion of an initial color of each display sub-pixel in the first initial color.

Optionally, at least two display sub-pixels in the reference pixel unit may include a first sub-pixel, a second sub-pixel, and a third sub-pixel, for example, the first sub-pixel may be a B sub-pixel, and the second sub-pixel may be a G sub-pixel, and the third sub-pixel may be an R sub-pixel. When the color of the sub-pixel is represented by the color coordinates, the first substitution proportion $R_{W1B}$ corresponding to the first sub-pixel, the first substitution proportion $R_{W1G}$ corresponding to the second sub-pixel, and the first substitution proportion $R_{W1R}$ corresponding to the third sub-pixel, satisfy:

$$R_{W11} = \left( \frac{\left( \frac{W_{1X} - R_X}{G_X - R_X} - \frac{W_{1Z} - R_Z}{G_Z - R_Z} \right) \Big/ W_{1Y}}{\frac{B_X - R_X}{G_X - R_X} - \frac{B_Z - R_Z}{G_Z - R_Z}} \right) \times R_Y$$

$$R_{W12} = \left( \frac{W_{1X} - R_X}{W_{1Y} \times (G_X - R_X)} - R_{W11} \times \frac{B_X - R_X}{G_X - R_X} \right) \times G_Y$$

$$R_{W13} = \left( \frac{1}{W_{1Y}} - R_{W11} - R_{W12} \right) \times B_Y.$$

where the color coordinates of the initial color of the first sub-pixel are ($B_X$, $B_Y$), and the color coordinates of the initial color of the second sub-pixel are ($G_X$, $G_Y$), the color coordinates of the initial color of the third sub-pixel are ($R_X$, $R_Y$), the color coordinates of the first initial color are ($W_{1X}$, $W_{1Y}$), the color coordinates of the target color are ($W_{2X}$, $W_{2Y}$), and $R_Z=1-R_X-R_Y$, $G_Z=1-G_X-G_Y$, $B_Z=1-B_X-B_Y$, $W_{1Z}=1-W_{1X}-W_{1Y}$.

Step 2013: A second substitution proportion of an initial color of each of the display sub-pixels with respect to the target color is acquired based on the target color and the initial colors of the at least two display sub-pixels.

The second substitution proportion is a proportion of an initial color of each display sub-pixel in the target color, and the target color is a color that should be shown by the reference pixel unit after chrominance compensation is performed on the reference pixel unit when the color of each display sub-pixel is its own initial color. For example, the target color may be a color that needs to be shown by the reference pixel unit finally as required by an application scenario when the color of each display sub-pixel is its own initial color. Exemplarily, when the colors of the display sub-pixels in each pixel unit of the display panel are their own initial colors, the display panel should show standard white in conventional display, but the target color shown by the display panel should be reddish white according to the requirements of the application scenario. Moreover, the implementation process of step 2013 may refer to step 2012 correspondingly, and details are not described herein again.

Step 2014: A first complementary color coefficient of the first initial color under the first luminance and a second complementary color coefficient of the target color under the first luminance are respectively determined based on the first substitution proportion and the second substitution proportion, The first complementary color coefficient is used to represent a degree of chrominance compensation that needs to be performed when acquiring the first initial color, and the second complementary color coefficient is used to represent a degree of chrominance compensation that needs to be performed when acquiring the target color. In the conventional display process of the RGBW OLED display device, the signals provided for each pixel unit for driving it to display, after being converted into the R signal, the G signal, the B signal and the W signal from the R initial signal, the G initial signal and the B initial signal, are supplied to the corresponding sub-pixels. Therefore, the first complementary color coefficient may be regarded as a degree to which the initial signal needs to be compensated when a conversion is performed according to the initial signal in the conversion process of the conventional display to obtain a signal for causing the pixel unit to show the first initial color. The second complementary color coefficient may be regarded as a degree to which the initial signal needs to be compensated when a conversion is performed according to the initial signal in the conversion process based on the conventional display to obtain a signal for causing the pixel unit to show the target color.

Figure 7:
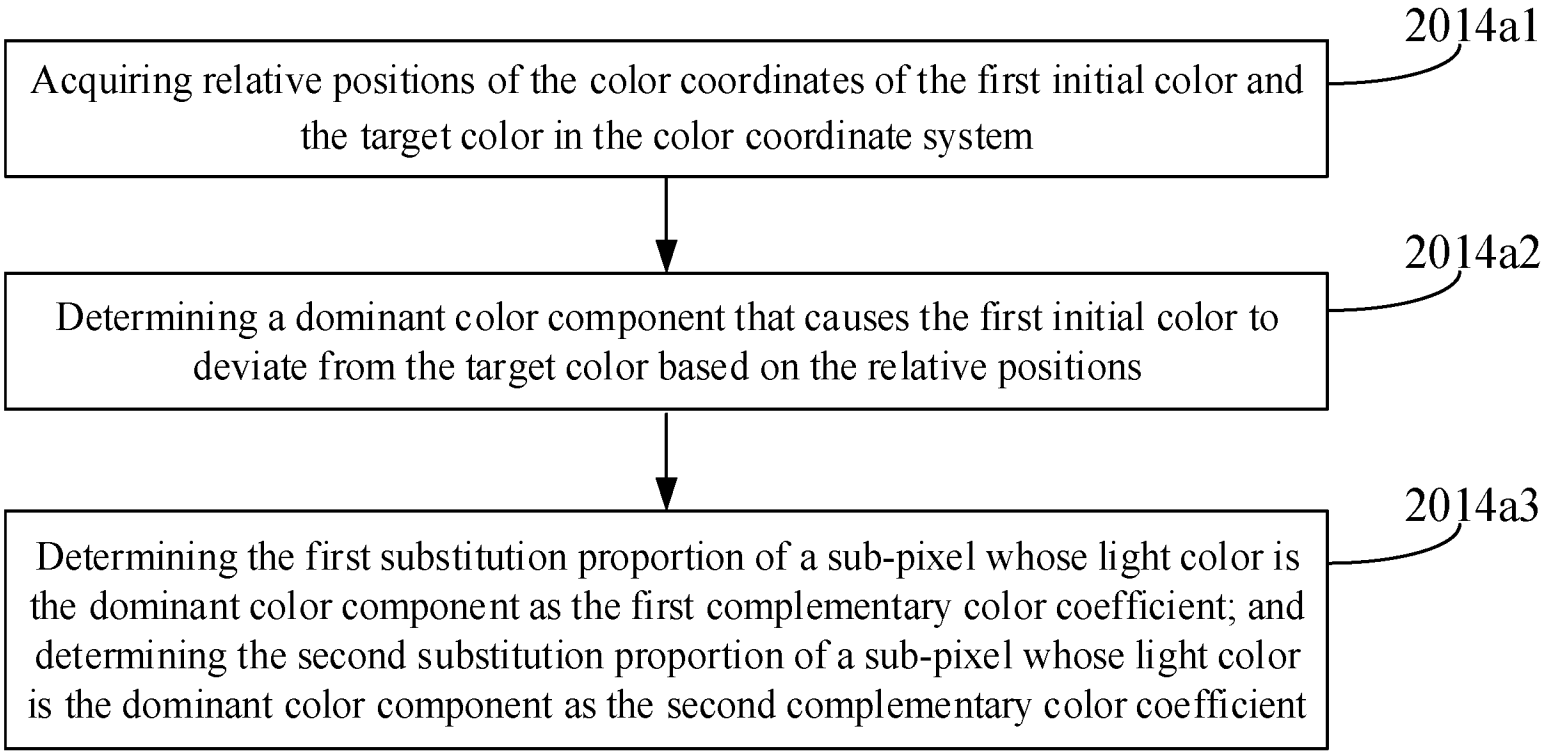
FIG. 7 is a flowchart of a method for determining the first complementary color coefficient and the second complementary color coefficient according to an embodiment of the present disclosure.

Optionally, the first complementary color coefficient and the second complementary color coefficient may be determined according to relative positions of color coordinates of the first initial color and the target color. For example, when the color of the sub-pixel is represented by the color coordinates, as shown in FIG. 7, an implementation thereof may include:

Step 2014*a*: Relative positions of the color coordinates of the first initial color and the target color in the color coordinate system are acquired.

The color coordinate system may be a color coordinate system established according to the chromatics standard CIE1931 made by the International Commission on Illumination. After the position of the color coordinates of the first initial color in the color coordinate system and the position of the color coordinates of the target color in the color coordinate system are determined, the relative positions of which may be determined. The relative positions may be expressed as at least three types, i.e., the first type: $W_{1Y} \geq W_{2Y}$, the second type: $W_{1X} \geq W_{2X}$ and $W_{1Y} < W_{2Y}$, and the third type: $W_{1X} < W_{2X}$ and $W_{1Y} < W_{2Y}$, wherein ($W_{1X}$, $W_{1Y}$) is the color coordinates of the first initial color, and ($W_{2X}$, $W_{2Y}$) is the color coordinates of the target color.

Step 2014*a*2: A dominant color component that causes the first initial color to deviate from the target color is determined based on the relative positions.

The dominant color component is a color component having a largest proportion in the color component that causes the first initial color to deviate from the target color. For example, when the first initial color is more inclined to be red with respect to the target color, the dominant color component may be red. Or, as shown in FIG. 4, when the first initial color is more inclined to be both blue and red with respect to the target color, and the degree of being inclined to be blue is greater than the degree of being inclined to be red, the dominant color component may be blue.

Exemplarily, each pixel unit may include a first sub-pixel, a second sub-pixel, and a third sub-pixel. When the color of the sub-pixel is represented by the color coordinates, the implementation process of determining, based on the relative positions, a dominant color component that causes the first initial color to deviate from the target color may include: determining the light color of the second sub-pixel as the dominant color component when the color coordinates ($W_{1X}$, $W_{1Y}$) of the first initial color and the color coordinates ($W_{2X}$, $W_{2Y}$) of the target color satisfy: $W_{1Y} \geq W_{2Y}$; determining the light color of the third sub-pixel as the dominant color component when the color coordinates ($W_{1X}$, $W_{1Y}$) of the first initial color and the color coordinates ($W_{2X}$, $W_{2Y}$) of the target color satisfy: $W_{1X} \geq W_{2X}$ and $W_{1Y} < W_{2Y}$; determining the light color of the first sub-pixel as the dominant color component when the color coordinates ($W_{1X}$, $W_{1Y}$) of the first initial color and the color coordinates ($W_{2X}$, $W_{2Y}$) of the target color satisfy: $W_{1X} < W_{2X}$ and $W_{1Y} < W_{2Y}$.

Step 2014*a*3: The first substitution proportion of a sub-pixel whose light color is the dominant color component is determined as the first complementary color coefficient; and the second substitution proportion of a sub-pixel whose light color is the dominant color component is determined as the second complementary color coefficient.

After a dominant color component that causes the first initial color to deviate from the target color is determined, when a conversion is performed according to the initial signal during the conversion process to obtain a signal that causes the pixel unit to show the first initial color, the chrominance compensation may be performed on the initial signal according to the first substitution proportion corresponding to the dominant color component; and when a conversion is performed according to the initial signal during the conversion process to obtain a signal that causes the pixel unit to show the target color, the chrominance compensation may be performed on the initial signal according to the second substitution proportion corresponding to the dominant color component. Therefore, the first substitution proportion of the sub-pixel whose light color is the dominant color component may be determined as the first complementary color coefficient, and the second substitution proportion of the sub-pixel whose light color is the dominant color component may be determined as the second complementary color coefficient.

That is, when the color coordinates ($W_{1X}$, $W_{1Y}$) of the first initial color and the color coordinates ($W_{2X}$, $W_{2Y}$) of the first target color satisfy: $W_{1Y} \geq W_{2Y}$, the first substitution proportion $R_{W12}$ corresponding to the second sub-pixel may be determined as the first complementary color coefficient $R_{W1}$, and the second substitution proportion $R_{W22}$ corresponding to the second sub-pixel may determined as the second complementary color coefficient $R_{W2}$, that is, $R_{W1}=R_{W12}$, $R_{W2}=R_{W22}$.

When the color coordinates ($W_{1X}$, $W_{1Y}$) of the first initial color and the color coordinates ($W_{2X}$, $W_{2Y}$) of the first target color satisfy: $W_{1X} \geq W_{2X}$ and $W_{1Y} < W_{2Y}$, the first substitution proportion $R_{W13}$ corresponding to the third sub-pixel may be determined as the first complementary color coefficient $R_{W1}$, and the second substitution proportion $R_{W23}$ corresponding to the third sub-pixel may be determined as the second complementary color coefficient $R_{W2}$, that is, $R_{W1}=R_{W13}$, $R_{W2}=R_{W23}$.

When the color coordinates ($W_{1X}$, $W_{1Y}$) of the first initial color and the color coordinates ($W_{2X}$, $W_{2Y}$) of the first target color satisfy: $W_{1X} < W_{2X}$ and $W_{1Y} < W_{2Y}$, the first substitution proportion $R_{W11}$ corresponding to the first sub-pixel may be determined as the first complementary color coefficient $R_{W1}$, and the second substitution proportion $R_{W21}$ corresponding to the first sub-pixel may be determined as the second complementary color coefficient $R_{W2}$, that is, $R_{W1}=R_{W11}$, $R_{W2}=R_{W21}$.

Step 2015: A complementary color gain of each display sub-pixel under the first luminance is determined based on the first complementary color coefficient and the second complementary color coefficient.

Optionally, the first complementary color coefficient $R_{W1}$, the second complementary color coefficient $R_{W2}$, and the complementary color gain $G_i$ of an $i^{th}$ sub-pixel under the first luminance satisfy:

$$G_i = \left( 1 - \frac{\frac{R_{W2i}}{R_{W2}} - \frac{R_{W1i}}{R_{W1}}}{\frac{R_{W2i}}{R_{W2}}} \right) \times (2^n - 1)$$

where $R_{W2i}$ is a second substitution proportion corresponding to the $i^{th}$ sub-pixel, $R_{W1i}$ is a first substitution proportion corresponding to the $i^{th}$ sub-pixel, n is the number of bits of the drive output signal provided for the sub-pixel, and the drive output signal is used to drive the sub-pixel to emit light.

Exemplarily, assuming that the drive output signals supplied to each of the display sub-pixels are all 8-bit signals, then n=8, the luminance of each of the display sub-pixels may be expressed by the gray value between [0, 255]. Correspondingly, the complementary color gain $G_1$ corresponding to the first sub-pixel, the complementary color gain $G_2$ corresponding to the second sub-pixel, and the complementary color gain $G_3$ corresponding to the third sub-pixel are respectively expressed as:

$$G_1 = \left( 1 - \frac{\frac{R_{W21}}{R_{W2}} - \frac{R_{W11}}{R_{W1}}}{\frac{R_{W21}}{R_{W2}}} \right) \times (2^8 - 1)$$

$$G_2 = \left( 1 - \frac{\frac{R_{W22}}{R_{W2}} - \frac{R_{W12}}{R_{W1}}}{\frac{R_{W22}}{R_{W2}}} \right) \times (2^8 - 1)$$

$$G_3 = \left( 1 - \frac{\frac{R_{W23}}{R_{W2}} - \frac{R_{W13}}{R_{W1}}}{\frac{R_{W23}}{R_{W2}}} \right) \times (2^8 - 1).$$

Step 202: A corresponding relationship is established between the luminance and the complementary color gain of each display sub-pixel under the target color and the initial color of each display sub-pixel.

After step 201 is performed on all the reference pixel units in the display panel, the complementary color gain of each display sub-pixel under different reference luminances may be obtained under the target color and the initial color of each display sub-pixel, based on which, a one-to-one corresponding relationship is performed on the display sub-pixel, the complementary color gain, and the luminance, and then a corresponding relationship recording the luminance and the complementary color gain of each display sub-pixel may be obtained. Alternatively, the corresponding relationship may be expressed in various forms, e.g., the corresponding relationship may be expressed by a table or a curve, and the curve corresponding to any of the display sub-pixels may be obtained by curve fitting according to the complementary color gain of the any of display sub-pixels under different reference luminances. For example, a plurality of reference luminances may be selected within the range of luminance that the display sub-pixel may display, and the complementary color gains corresponding to the display sub-pixels at each reference luminance are obtained respectively, and on the basis that each reference luminance and the corresponding complementary color gain constitute a feature point, curve fitting is performed on a plurality of feature points by a quadratic curve fitting method to obtain a curve to represent the corresponding relationship between the luminance and the complementary color gain of the display sub-pixel.

In addition, as known from the relationships that the color coordinates and luminances of the first sub-pixel, the second sub-pixel, the third sub-pixel and the initial color satisfy, when any parameter of the color coordinates and luminances of the first sub-pixel, the second sub-pixel, the third sub-pixel and the initial color varies, the first substitution proportion and the second substitution proportion may corresponding vary, such that the compensation gain varies. Therefore, the compensation gains of any of the display sub-pixels under different luminances for compensating the target pixel unit from the initial color to a target color under the target luminance are different. Correspondingly, Each display sub-pixel may correspond to a plurality of sets of corresponding relationships, each of which is used to indicate the corresponding relationship between the luminance and the compensation gain when the reference pixel unit where the display sub-pixel is located is compensated to the target color under a luminance based on an initial color of the display sub-pixel when the display sub-pixel is under different luminances.

Figure 8:
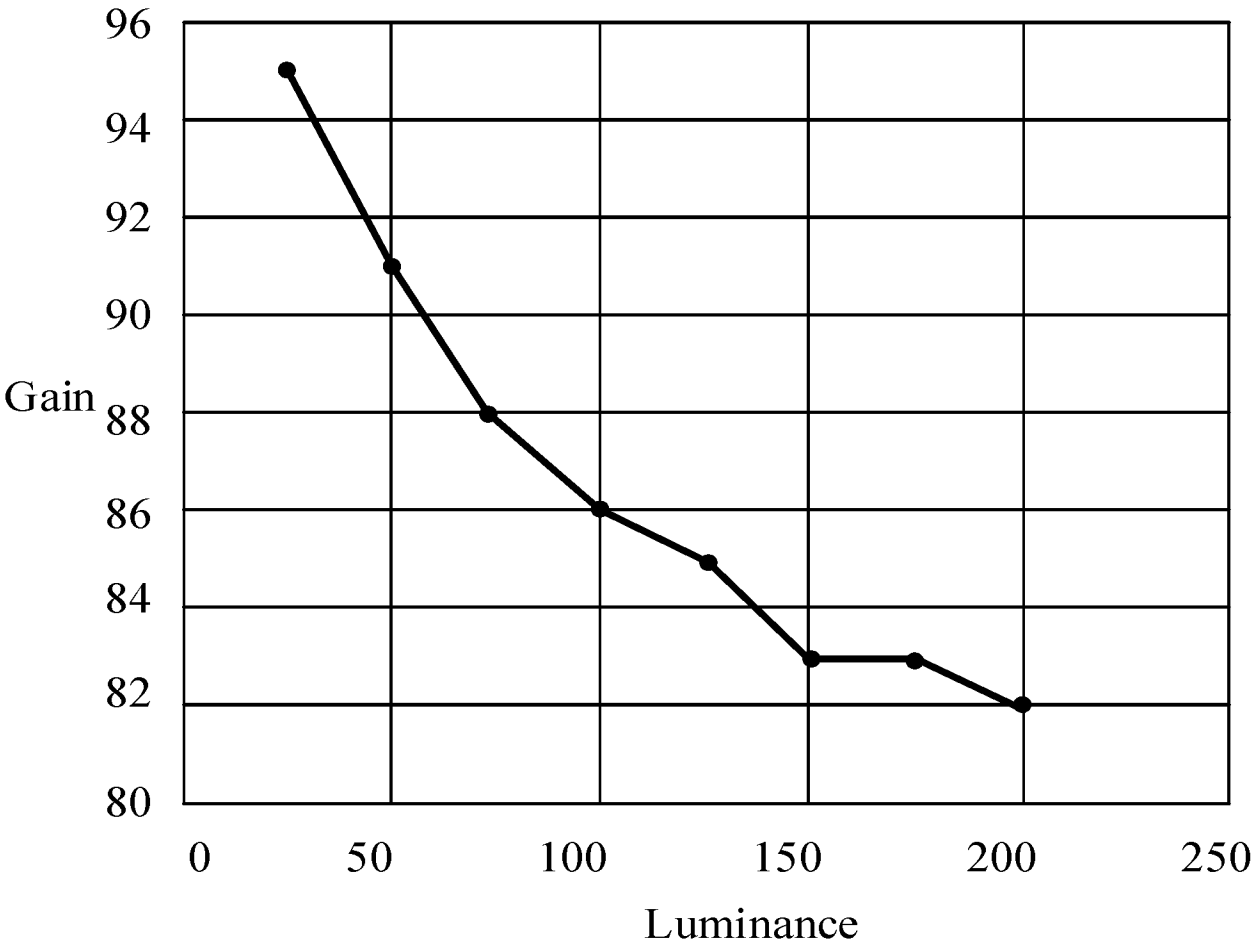
FIG. 8 is a schematic diagram of complementary color gains corresponding to a B sub-pixel under different luminances according to an embodiment of the present disclosure.
Figure 9:
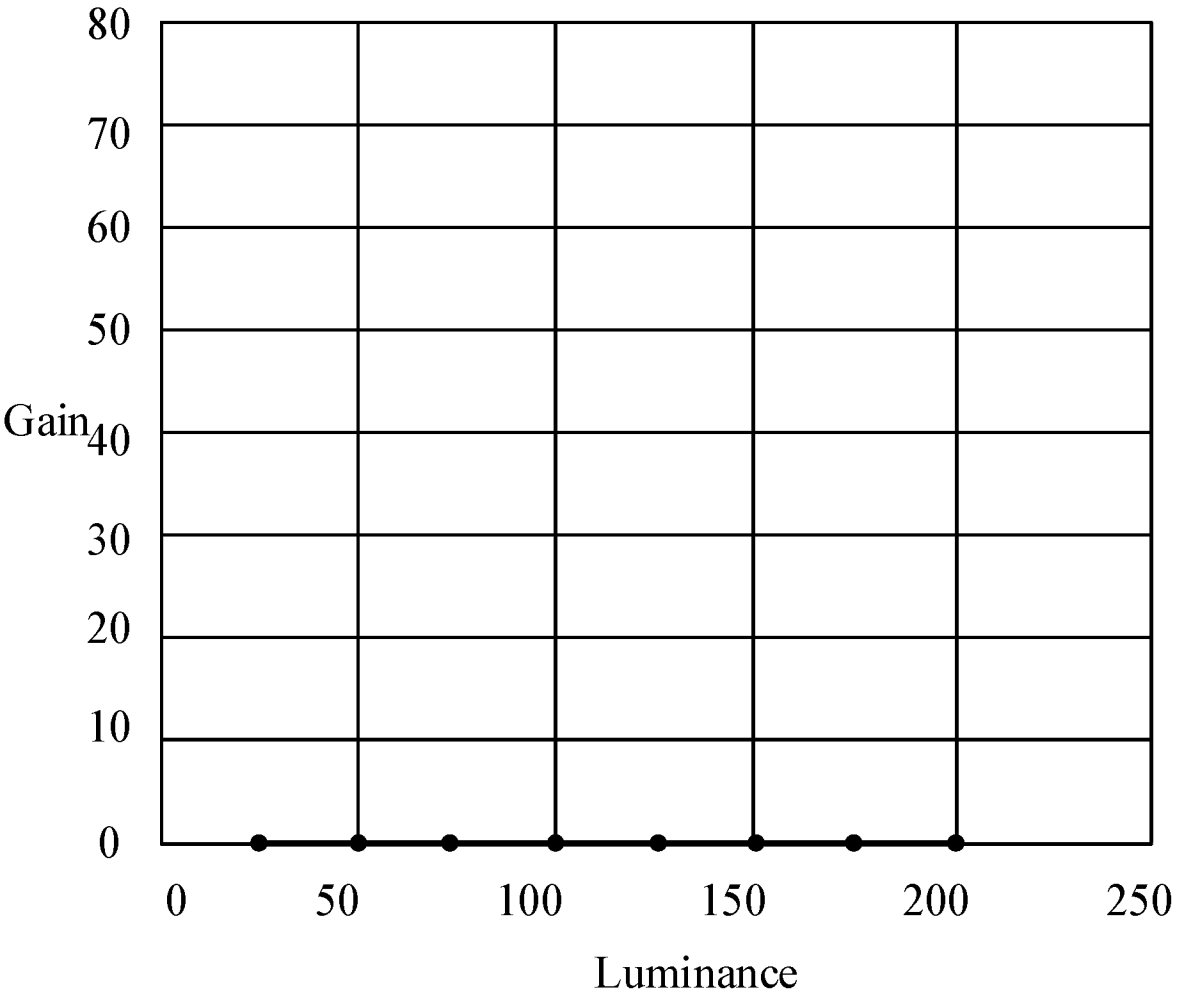
FIG. 9 is a schematic diagram of complementary color gains corresponding to a G sub-pixel under different luminances according to an embodiment of the present disclosure.
Figure 10:
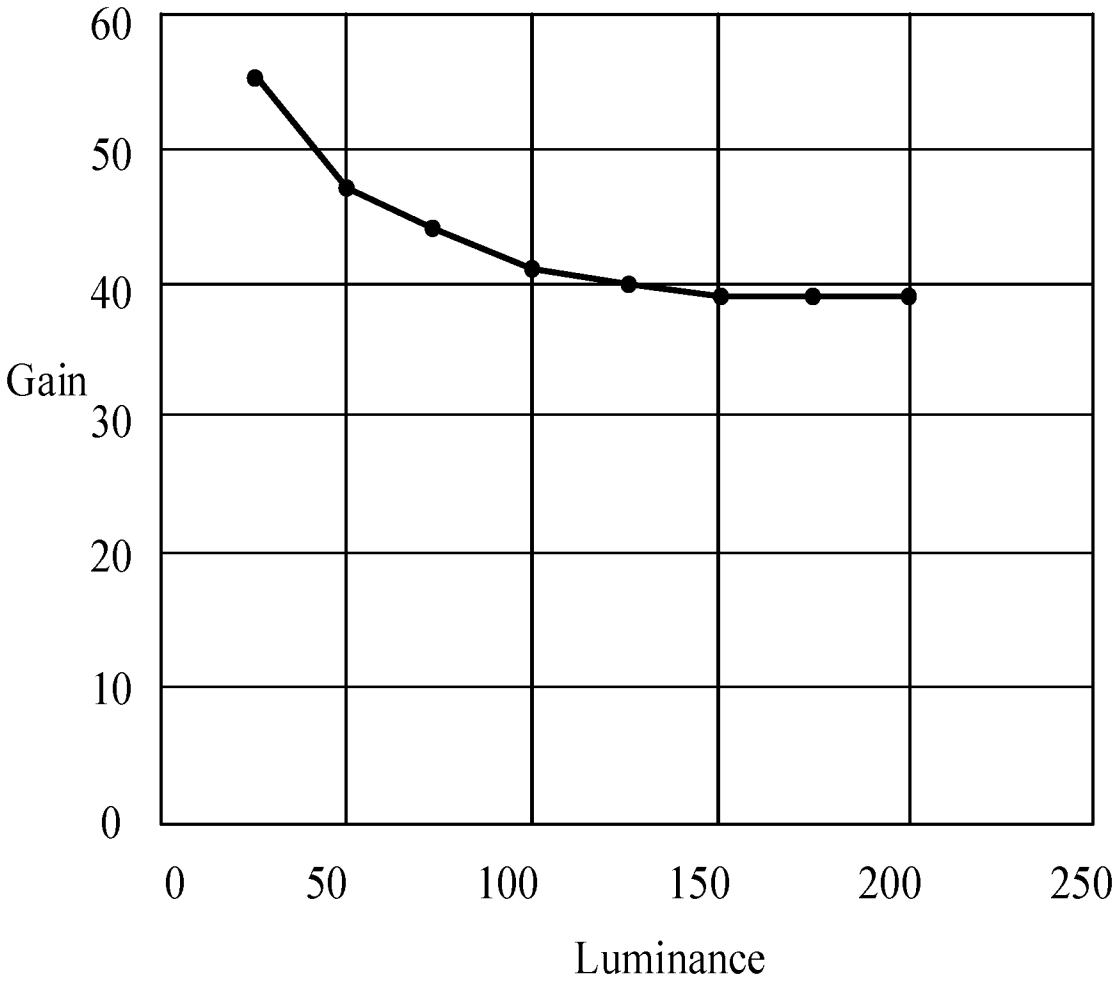
FIG. 10 is a schematic diagram of complementary color gains corresponding to a R sub-pixel under different luminances according to an embodiment of the present disclosure.

Exemplarily, assuming that the first sub-pixel is a B sub-pixel, the second sub-pixel is a G sub-pixel, and the third sub-pixel is an R pixel, when the corresponding relationship between the luminance and the complementary color gain is represented by a curve, as to the complementary color gain corresponding to the B sub-pixel under different luminances, reference may be made to FIG. 8. The curve of FIG. 8 represents the corresponding relationship between the luminance and the compensation gain when the reference pixel unit where the B sub-pixel is located is compensated to the target color under a luminance based on an initial color of the B sub-pixel. As to the complementary color gain corresponding to the G sub-pixels under different luminances, reference may be made to FIG. 9. The curve of FIG. 9 represents the corresponding relationship between the luminance and the compensation gain when the reference pixel unit where the G sub-pixel is located is compensated to the target color under a luminance based on an initial color of the G sub-pixel. As to the complementary color gain corresponding to the R sub-pixel under different luminances, reference may be made to FIG. 10. The curve of FIG. 10 is used to represent the corresponding relationship between the luminance and the compensation gain when the reference pixel unit where the R sub-pixel is located is compensated to the target color under a luminance based on an initial color of the R sub-pixel. Moreover, according to FIG. 8-FIG. 10, it may be seen that the corresponding relationships between different sub-pixels and the complementary color gain under different luminances exhibit different varying trends.

Since the compensation gains of any of the display sub-pixels under different luminances for compensating the target pixel unit from the initial color to a target color under the target luminance are different, different chroma compensations may be practiced with respect to different luminances, such that the chroma compensation is refined, and thus the display effect of the display panel is improved.

Step 203: An initial color of the display sub-pixel in the target pixel unit under the target luminance, and a target color of the target pixel unit under the target luminance are acquired.

The target pixel unit and the reference pixel unit may be pixel units in the same display panel. Since the pixel units in the same display panel have substantially the same display characteristics, when chrominance compensation is performed on the target pixel unit according to the corresponding relationship acquired by the reference pixel unit, the accuracy of the compensation may be ensured.

The target color of the target pixel unit may be determined under the indication of the application requirement when the colors of at least two display sub-pixels in the target pixel unit are their own initial colors, wherein the target color of the target pixel unit may be a specified color based on the indication of the application requirement when the colors of respective display sub-pixels in the target pixel unit are their own initial colors. The initial color of the display sub-pixel may be determined according to the picture that needs to be displayed. And the initial color of the display sub-pixel and the target color of the target pixel unit corresponding thereto may be all stored in the memory of the display device. In the display process, the initial color and the target color may be obtained by reading the data stored in the memory.

Step 204: A complementary color gain of each of display sub-pixels under the target luminance is acquired based on the target color and the initial color of each of the display sub-pixels.

Figure 11:
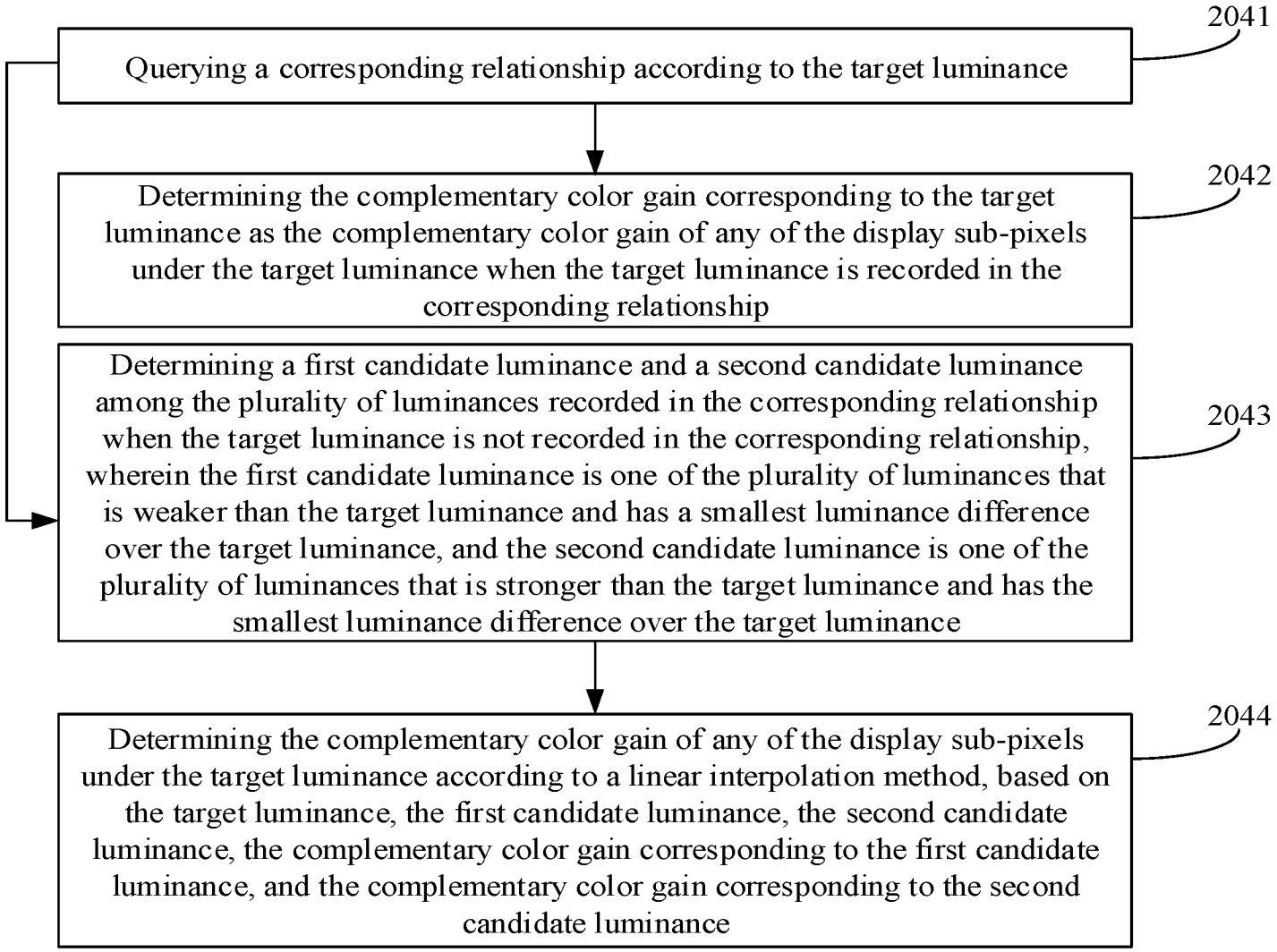
FIG. 11 is a flowchart of a method for querying a corresponding relationship between the luminance and the complementary color gain of any of the display sub-pixels to determine the complementary color gain of the any of the display sub-pixels under the target luminance based on the target color and the initial color of any of the display sub-pixels according to an embodiment of the present disclosure.

Optionally, the corresponding relationship between the luminance and the complementary color gain of any of the display sub-pixels may be queried based on the target color and the initial color of any of the display sub-pixels to determine the complementary color gain of any of the display sub-pixels under the target luminance. The corresponding relationship records the complementary color gain of any of the display sub-pixels by which the target pixel unit is compensated to the target color under a luminance under the initial color and different luminances. Exemplarily, referring to FIG. 11, the implementation process thereof may include:

Step 2041: A corresponding relationship is queried according to the target luminance.

The corresponding relationship may record the complementary color gains corresponding to the display sub-pixels at a plurality of reference luminances, that is, the corresponding relationship may not record the complementary color gains of the display sub-pixels under all the luminances. Therefore, when the complementary color gain corresponding to the display sub-pixel under the target luminance is obtained, the corresponding relationship may be firstly queried according to the target luminance to determine whether the target luminance is recorded in the corresponding relationship, and when the target luminance is recorded in the corresponding relationship, step 2042 is performed; when the target luminance is not recorded in the corresponding relationship, step 2043 is performed.

Step 2042: The complementary color gain corresponding to the target luminance is determined as t The complementary color gain of any of the display sub-pixels under the target luminance when the target luminance is recorded in the corresponding relationship.

When the target luminance is recorded in the corresponding relationship, the corresponding relationship may be queried according to the target luminance, and the complementary color gain corresponding to the display sub-pixel under the target luminance is determined as the complementary color gain of any of the display sub-pixels under the target luminance (for convenience of depiction, hereinafter it is referred to as the target complementary color gain).

Exemplarily, assuming thunder the target luminance is 100 nits, the plurality of reference luminances are LW1=25 nits, LW2=50 nits, LW3=75 nits, LW4=100 nits, LW5=125 nits, LW6=150 nits, LW7=175 nits respectively, and the corresponding relationships shown in FIG. 8 to FIG. 10 record the complementary color gain corresponding to each of the display sub-pixels in the target pixel unit under the plurality of reference luminances, it may be seen that the target complementary color gain corresponding to the target luminance is recorded in the corresponding relationship; by querying the corresponding relationships shown in FIG. 8 to FIG. 10 respectively according to the target luminance, it may be obtained that: the complementary color gain corresponding to the B sub-pixel under the target luminance is 86, the complementary color gain corresponding to the G sub-pixel under the target luminance is 0, and the complementary color gain corresponding to the R sub-pixel under the target luminance is 41, then 86 may be determined as the target complementary color gain of the B sub-pixel under the target luminance, 0 may be determined as the target complementary color gain of the G sub-pixel under the target luminance, and 41 is determined as the target complementary color gain of the R sub-pixel under the target luminance.

Step 2043: A first candidate luminance and a second candidate luminance are determined among the plurality of luminances recorded in the corresponding relationship when the target luminance is not recorded in the corresponding relationship, wherein the first candidate luminance is one of the plurality of luminances that is weaker than the target luminance and has a smallest luminance difference over the target luminance, and the second candidate luminance is one of the plurality of luminances that is stronger than the target luminance and has the smallest luminance difference over the target luminance.

In the embodiment of the present disclosure, the plurality of reference luminances excluding the minimum luminance and the maximum luminance may be used as dividing points, and the luminance range taking the minimum luminance and the maximum luminance as the end points may be divided into a plurality of luminance intervals. At this time, when the target luminance is not recorded in the corresponding relationship, the target luminance interval where the target luminance is located may be determined first, and then the complementary color gain corresponding to the target luminance may be determined according to the complementary color gains corresponding to the two reference luminances at the end points of the target luminance interval, i.e., step 2064 is performed, and the two reference luminances at the end points of the target luminance interval are the first candidate luminance and the second candidate luminance respectively.

Exemplarily, assuming that the plurality of reference luminances are: LW1=25 nits, LW2=50 nits, LW3=75 nits, LW4=100 nits, LW5=125 nits, LW6=150 nits, LW7=175 nits, take LW2, LW3, LW4, LW5 And LW6 as dividing points, and the luminance range [25 nits, 175 nits] may be divided into six luminance intervals, which are [25 nits, 50 nits], [50 nits, 75 nits], [75 nits, 100 nits], [100 nits, 125 nits], [125 nits, 150 nits] and [150 nits, 175 nits]; when the target luminance is 40 nits, it may be determined thunder the target luminance interval where the target luminance is located is [25 nits, 50 nits], and then 25 nits may be determined as the first candidate luminance, and 50 nits may be determined as the second candidate luminance.

Step 2044: The complementary color gain of any of the display sub-pixels under the target luminance is determined according to a linear interpolation method, based on the target luminance, the first candidate luminance, the second candidate luminance, the complementary color gain corresponding to the first candidate luminance, and the complementary color gain corresponding to the second candidate luminance.

After the first candidate luminance and the second candidate luminance are determined, according to the first candidate luminance and the second candidate luminance, the target complementary color gain corresponding to any of display sub-pixels under the target luminance is determined based on the linear interpolation method.

In an implementation, it is assumed thunder the target luminance is L1, the first candidate luminance is L2, and the second candidate luminance is L3, and the complementary color gain corresponding to the display sub-pixel i under the first candidate luminance is $G_{i1}$, and the complementary color gain corresponding to the display sub-pixel i under the second candidate luminance is $G_{i2}$, the target complementary color gain $G_{iL1}$ corresponding to the display sub-pixel i under the target luminance may be determined according to a linear interpolation formula, which is expressed as:

$$G_{iL1} = G_{i1} - \frac{G_{i1} - G_{i2}}{L2 - L3} \times (L2 - L1).$$

Exemplarily, assuming thunder the target luminance is 40 nits, according to the corresponding relationships shown in FIG. 8-FIG. 10, it may be determined that the first candidate luminance is 25 nits, the second candidate luminance is 50 nits, the complementary color gains corresponding to the first sub-pixel, the second sub-pixel, and the third sub-pixel under the first candidate luminance are 95, 0, and 55 respectively, the complementary color gains corresponding to the first sub-pixel, the second sub-pixel, and the third sub-pixel under the second candidate luminance are 91, 0, and 47 respectively, and based on the linear interpolation formula, it may be determined the target complementary color gains corresponding to the first sub-pixel, the second sub-pixel, and the third sub-pixel under the target luminance are 92.6, 0, and 50.2 respectively.

It should be noted that, in the display process of the display panel, the implementation process of calculating the complementary color gain of each display sub-pixel under the target luminance in real time may refer to step 2011 to step 2015 correspondingly, at this time, the first luminance in steps 2011 to 2015 is the target luminance. Correspondingly, since it is unnecessary to use the corresponding relationship between the luminance and the complementary color gain in the process of calculating the complementary color gain in real time, the above steps 201 to 202 may be selected not to be performed.

Step 205: A drive output signal provided for any of the display sub-pixels is determined based on a complementary color gain of any of the display sub-pixels under the target luminance; and the drive output signal is provided for the any of the display sub-pixels for compensating for chrominance of the target pixel unit based on the drive output signal.

Since the color of each display sub-pixel is obtained by adding a filter to the white light-emitting sub-pixel, after the target complementary color gain of the display sub-pixel is determined, the luminance of the white light-emitting sub-pixel in the display sub-pixel may be changed according to the target complementary color gain, such that the color of the display sub-pixel is changed, thereby changing the light color of the target pixel unit, to achieve the chrominance compensation for the target pixel unit. That is, the target output luminance of the any display sub-pixel may be determined according to the target complementary color gain, and according to the target output luminance of the any display sub-pixel, the data signal desired for driving the any display sub-pixel to the target output luminance is determined, and the data signal is sent to the source driver for generating a corresponding drive output signal according to the data signal, and the drive output signal is provided for the any display sub-pixel and is used to charge the corresponding sub-pixel to drive the corresponding sub-pixel for display, thereby implementing chrominance compensation for the target pixel unit.

Alternatively, the determining, according to the target complementary color gain, the target output luminance of any of the display sub-pixels may include: determining the luminance gain based on the target complementary color gain, updating the sum of the original luminance and the luminance gain of the any display sub-pixel as the corresponding target output luminance, and remaining the luminance of the white sub-pixel in the target pixel unit unchanged, wherein the luminance gain of the any display sub-pixel may be determined based on the maximum gray value and the target luminance that may be displayed by the target pixel unit. For example, the luminance gain M, the target luminance L, the target complementary color gain G, and the maximum gray value Q satisfy: $M=(G/Q)\times L$.

In summary, the chroma compensation method according to the embodiment of the present disclosure includes: acquiring a complementary color gain of each of the display sub-pixels under the target luminance based on the target color and the initial color of each of the display sub-pixels, and compensating for chrominance of the target pixel unit based on the complementary color gain, and compensating for the color shown by the display panel according to different application scenarios, such that the color shown by the display panel satisfies different application scenarios, thereby improving display flexibility of the display panel and enabling the display panel to be applied to a variety of application scenarios. Since the compensation gains of any of the display sub-pixels under different luminances for compensating the target pixel unit from the initial color to a target color under the target luminance are different, different chroma compensations may be practiced with respect to different luminances, such that the chroma compensation is refined, and thus the display effect of the display panel is improved.

The sequence of the steps of the chroma compensation method according to the embodiment of the present disclosure may be suitably adjusted, and reduced or added according to the actual conditions. For example, step 201 to step 202 may be selectively and optionally performed according to the actual application requirements. Any person skilled in the art may readily envisage other methods within the technical scope of the present disclosure. These methods shall all be covered within the protection scope of the present disclosure, which are thus not described herein any further.

Figure 12:
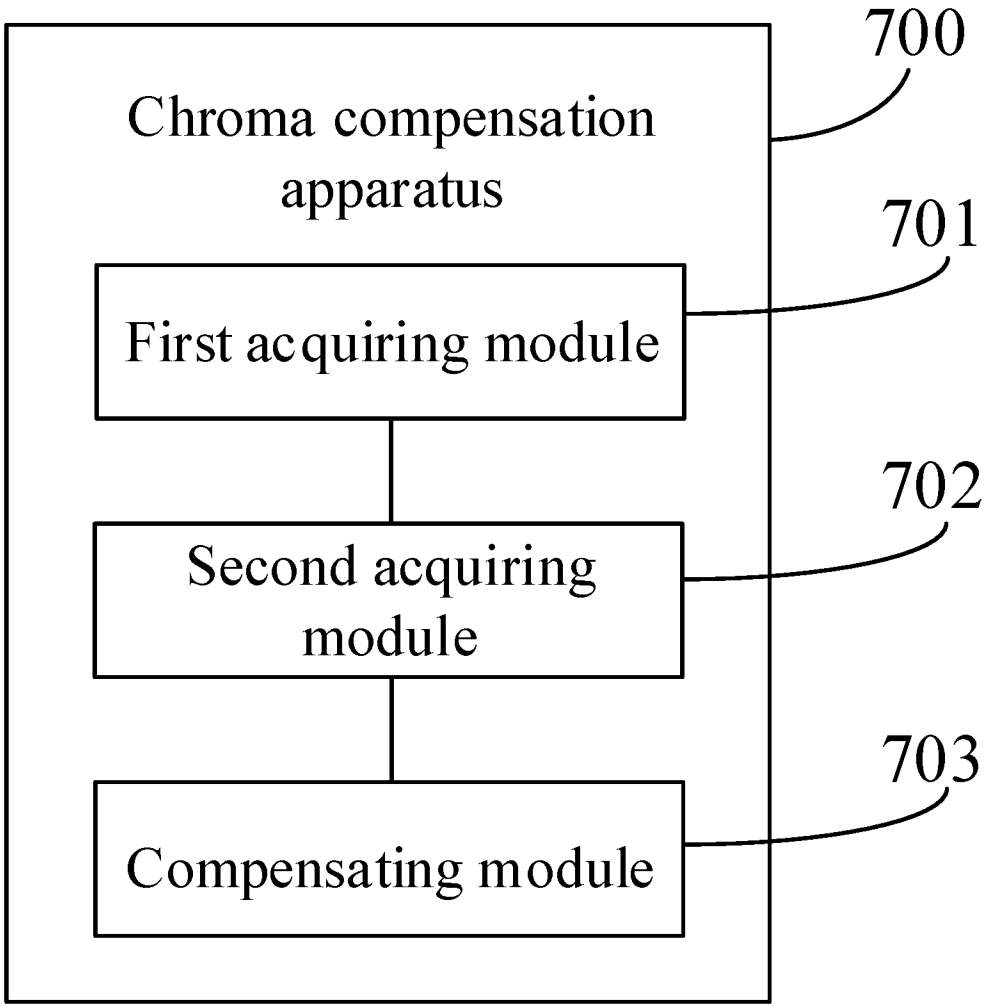
FIG. 12 is a schematic structural diagram of a chroma compensation apparatus according to an embodiment of the present disclosure.

An embodiment of the present disclosure provides a chroma compensation apparatus 700. As shown in FIG. 12, the apparatus 700 may include:

a first acquiring module 701, configured to acquire an initial color of a display sub-pixel in a target pixel unit under a target luminance, and a target color of the target pixel unit under the target luminance, the target pixel unit including: at least two display sub-pixels of different light colors;

a second acquiring module 702, configured to acquire a complementary color gain of each of the display sub-pixels under the target luminance based on the target color and an initial color of each of the display sub-pixels; and a compensating module 703, configured to compensate for chrominance of the target pixel unit based on a complementary color gain of each of the display sub-pixels under the target luminance;

wherein the complementary color gain of any of the display sub-pixels under the target luminance is used to represent a degree to which the any of the display sub-pixels needs to be compensated when the color of the target pixel unit is compensated from the initial color to the target color under the target luminance.

Optionally, the compensation gains of any of the display sub-pixels under different luminances for compensating the target pixel unit from the initial color to a target color under the target luminance are different.

In summary, the chroma compensation apparatus according to the embodiment of the present disclosure includes: a second acquiring module, configured to acquire a complementary color gain of each of the display sub-pixels under the target luminance based on the target color and an initial color of each of the display sub-pixels; and a compensating module, configured to compensate for chrominance of the target pixel unit based on the complementary color gain, and compensate for the color shown by the display panel according to different application scenarios, such that the color shown by the display panel satisfies different application scenarios, thereby improving display flexibility of the display panel and enabling the display panel to be applied to a variety of application scenarios.

Optionally, the second acquiring module 702 is configured to query a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of any of the display sub-pixels by which the target pixel unit is compensated from the initial color to the target color under different luminances.

In addition, Since the compensation gains of any of the display sub-pixels under different luminances for compensating the target pixel unit from the initial color to a target color under the target luminance are different, different chroma compensations may be practiced with respect to different luminances, such that the chroma compensation is refined, and thus the display effect of the display panel is improved.

Optionally, the second acquiring module 702 is further configured to acquire a complementary color gain of each of the display sub-pixels at a plurality of reference luminances based on the target color and the initial color of each of the display sub-pixels.

Figure 13:
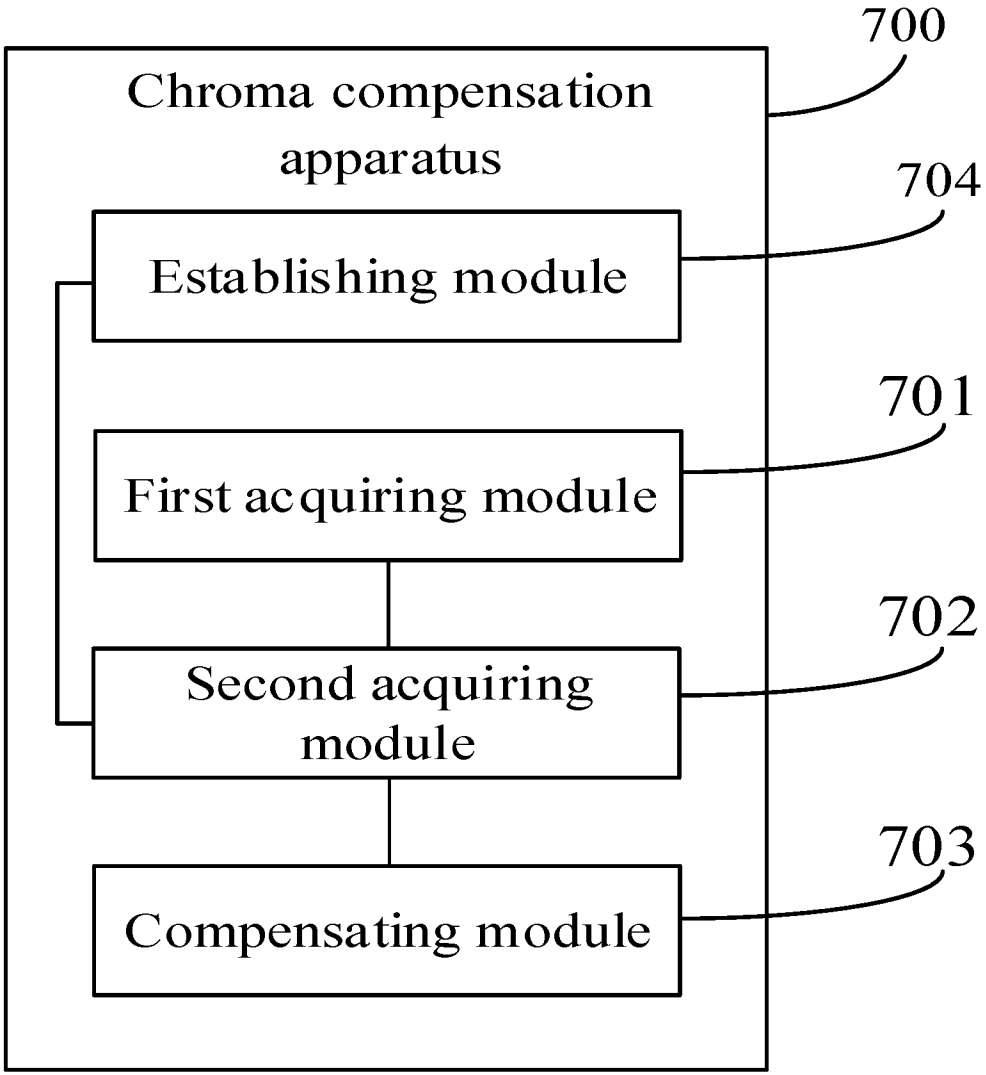
FIG. 13 is a schematic structural diagram of another chroma compensation apparatus according to an embodiment of the present disclosure.

Correspondingly, as shown in FIG. 13, the apparatus 700 may further include: an establishing module 704, configured to establish a corresponding relationship between the luminance and the complementary color gain of each of the display sub-pixels under the target color and the initial color of each of the display sub-pixels.

Figure 14:
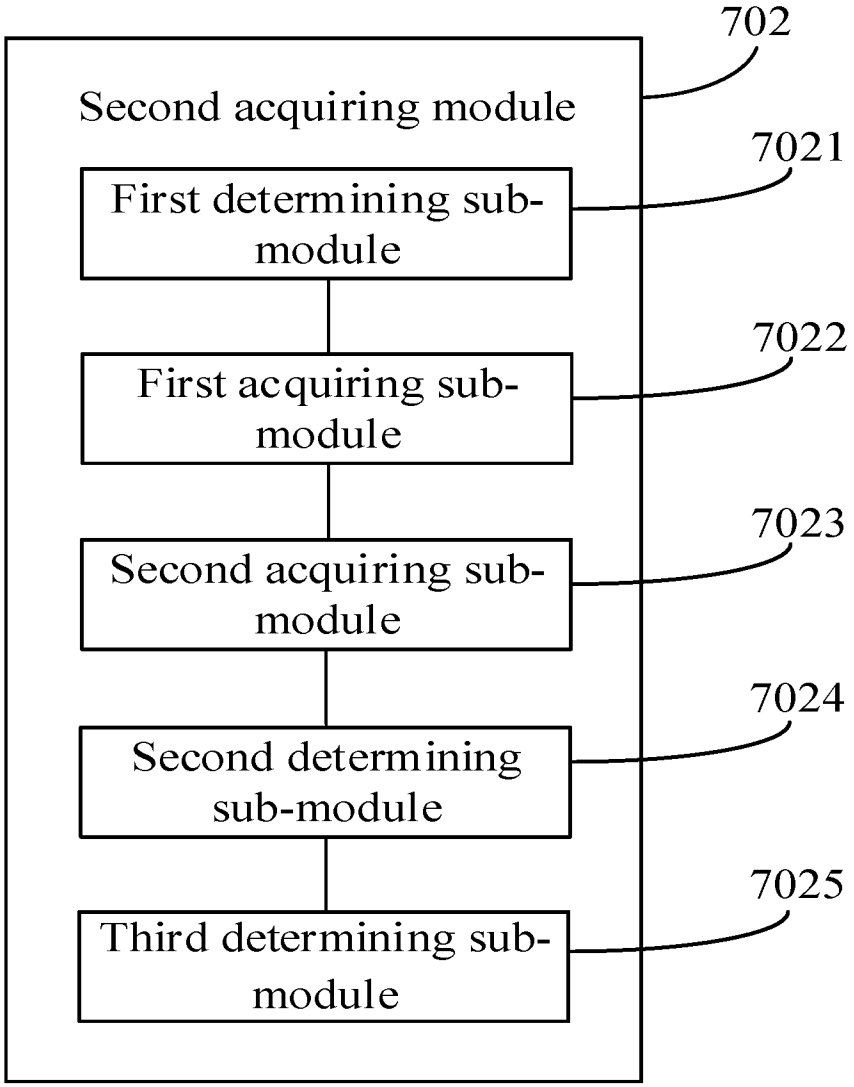
FIG. 14 is a schematic structural diagram of a second acquiring module according to an embodiment of the present disclosure.

Optionally, as shown in FIG. 14, the second acquiring module 702 may include:

a first determining sub-module 7021, configured to determine, at a first luminance, a first initial color of the target pixel unit based on an initial color of the at least two display sub-pixels, the first luminance being any one of the plurality of reference luminances;

a first acquiring sub-module 7022, configured to acquire, based on the first initial color and the initial color of the at least two display sub-pixels, a first substitution proportion of an initial color of each of the display sub-pixels with respect to the first initial color, the first substitution proportion being a proportion of the initial color of each of the display sub-pixels in the first initial color;

a second acquiring sub-module 7023, configured to acquire, based on the target color and an initial color of the at least two display sub-pixels, a second substitution proportion of an initial color of each of the display sub-pixels with respect to the target color, the second substitution proportion being a proportion of the initial color of each of the display sub-pixels in the target color;

a second determining sub-module 7024, configured to determine, based on the first substitution proportion and the second substitution proportion, a first complementary color coefficient of the first initial color under the first luminance and a second complementary color coefficient of the target color under the first luminance respectively, wherein the first complementary color coefficient is used to represent a degree of chrominance compensation that needs to be performed when acquiring the first initial color, and the second complementary color coefficient is used to represent a degree of chrominance compensation that needs to be performed when acquiring the target color;

a third determining sub-module 7025, configured to determine a complementary color gain of each of the display sub-pixels under the first luminance based on the first complementary color coefficient and the second complementary color coefficient.

Optionally, the at least two display sub-pixels may include a first sub-pixel, a second sub-pixel, and a third sub-pixel; when colors of the sub-pixels are represented by color coordinates, a $j^{th}$ substitution proportion $R_{Wj1}$ corresponding to the first sub-pixel, a $j^{th}$ substitution proportion $R_{Wj2}$ corresponding to the second sub-pixel, and a j substitution proportion $R_{Wj3}$ corresponding to the third sub-pixel satisfy:

$$R_{Wj1} = \left( \frac{\left( \frac{W_{jX} - R_X}{G_X - R_X} - \frac{W_{jZ} - R_Z}{G_Z - R_Z} \right) \Big/ W_{jY}}{\frac{B_X - R_X}{G_X - R_X} - \frac{B_Z - R_Z}{G_Z - R_Z}} \right) \times R_Y$$

$$R_{Wj2} = \left( \frac{W_{jX} - R_X}{W_{jY} \times (G_X - R_X)} - R_{W11} \times \frac{B_X - R_X}{G_X - R_X} \right) \times G_Y$$

$$R_{Wj3} = \left( \frac{1}{W_{jY}} - R_{W11} - R_{W12} \right) \times B_Y$$

where j is 1 or 2, the color coordinates of the initial color of the first sub-pixel are $(B_X, B_Y)$, and the color coordinates of the initial color of the second sub-pixel are $(G_X, G_Y)$, the color coordinates of the initial color of the third sub-pixel are $(R_X, R_Y)$, the color coordinates of the first initial color are $(W_{1X}, W_{1Y})$, the color coordinates of the first target color are $(W_{2X}, W_{2Y})$, and $R_Z=1-R_X-R_Y$, $G_Z=1-G_X-G_Y$, $B_Z=1-B_X-B_Y$, $W_{1Z}=1-W_{1X}-W_{1Y}$, $W_{2Z}=1-W_{2X}-W_{2Y}$.

Optionally, when the colors of the sub-pixels are represented by color coordinates, the second determining sub-module 7024 is configured to:

acquire relative positions of the color coordinates of the first initial color and the target color in a color coordinate system;

determine, based on the relative positions, a dominant color component that causes the first initial color to deviate from the target color, the dominant color component being a color component having the largest proportion in the color component that cause the first initial color to deviate from the target color;

determine the first substitution proportion of a sub-pixel whose light color is the dominant color component as the first complementary color coefficient; and determine the second substitution proportion of a sub-pixel whose light color is the dominant color component as the second complementary color coefficient.

Optionally, the at least two display sub-pixels may include a first sub-pixel, a second sub-pixel, and a third sub-pixel; and the second determining sub-module 7024 is configured to:

determine the light color of the second sub-pixel as the dominant color component when the color coordinates $(W_{1X}, W_{1Y})$ of the first initial color and the color coordinates $(W_{2X}, W_{2Y})$ of the first target color satisfy: $W_{1Y} \geq W_{2Y}$;

determine the light color of the third sub-pixel as the dominant color component when the color coordinates $(W_{1X}, W_{1Y})$ of the first initial color and the color coordinates $(W_{2X}, W_{2Y})$ of the first target color satisfy: $W_{1X} \geq W_{2X}$ and $W_{1Y} < W_{2Y}$; and determine the light color of the first sub-pixel as the dominant color component when the color coordinates $(W_{1X}, W_{1Y})$ of the first initial color and the color coordinates $(W_{2X}, W_{2Y})$ of the first target color satisfy: $W_{1X} < W_{2X}$ and $W_{1Y} < W_{2Y}$.

Optionally, the first complementary color coefficient $R_{W1}$, the second complementary color coefficient $R_{W2}$, and the complementary color gain $G_i$ of a $i^{th}$ sub-pixel under the first luminance satisfy:

$$G_i = \left( 1 - \frac{\frac{R_{W2i}}{R_{W2}} - \frac{R_{W1i}}{R_{W1}}}{\frac{R_{W2i}}{R_{W2}}} \right) \times (2^n - 1)$$

where $R_{W2i}$ is a second substitution proportion corresponding to the $i^{th}$ sub-pixel, $R_{W1i}$ is a first substitution proportion corresponding to the it sub-pixel, n is the number of bits of the drive output signal provided for the sub-pixel, and the drive output signal is used to drive the sub-pixel to emit light.

Optionally, the second acquiring module 702 is configured to:

query the corresponding relationship according to the target luminance;

determine a complementary color gain corresponding to the target luminance as the complementary color gain when the target luminance is recorded in the corresponding relationship;

determine a first candidate luminance and a second candidate luminance among the plurality of luminances recorded in the corresponding relationship when the target luminance is not recorded in the corresponding relationship, the first candidate luminance being one of the plurality of luminances that is weaker than the target luminance and has a smallest luminance difference over the target luminance, the second candidate luminance being one of the plurality of luminances that is stronger than the target luminance and has the smallest luminance difference over the target luminance; and determine the complementary color gain according to a linear interpolation method, based on the target luminance, the first candidate luminance, the second candidate luminance, the complementary color gain corresponding to the first candidate luminance, and the complementary color gain corresponding to the second candidate luminance.

Optionally, the compensating module 703 is configured to:

determine a drive output signal provided for any of the display sub-pixels based on a complementary color gain of any of the display sub-pixels under the target luminance, the drive output signal being configured for driving the sub-pixel to emit light; and provide the drive output signal for any of the display sub-pixels for compensating for chrominance of the target pixel unit.

In summary, the chroma compensation apparatus according to the embodiment of the present disclosure includes: a second acquiring module, configured to acquire a complementary color gain of each of the display sub-pixels under the target luminance based on the target color and an initial color of each of the display sub-pixels; a compensating module, configured to compensate for chrominance of the target pixel unit based on the complementary color gain, and compensate for the color shown by the display panel according to different application scenarios, such that the color shown by the display panel satisfies different application scenarios, thereby improving display flexibility of the display panel and enabling the display panel to be applied to a variety of application scenarios. Since the compensation gains of any of the display sub-pixels under different luminances for compensating the target pixel unit from the initial color to a target color under the target luminance are different, different chroma compensations may be practiced with respect to different luminances, such that the chroma compensation is refined, and thus the display effect of the display panel is improved.

An embodiment of the present disclosure provides a display device. The display device includes a display panel and a chroma compensation apparatus according to an embodiment of the present disclosure. The display device may be any product or component having a display function such as a liquid crystal panel, an electronic paper, a mobile phone, a tablet computer, a television, a display, a notebook computer, a digital photo frame, a navigator, and the like. Exemplarily, the display device may be an OLED display device.

Figure 15:
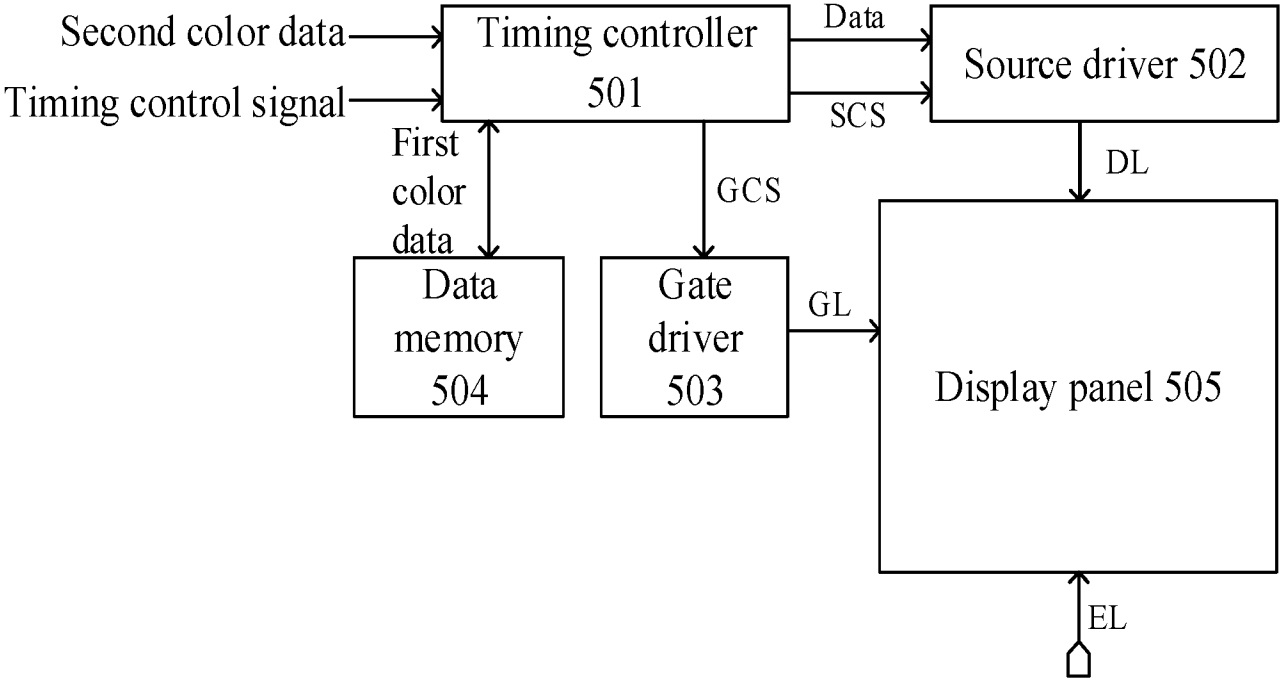
FIG. 15 is a schematic structural diagram of a display device according to an embodiment of the present disclosure.

Optionally, referring to FIG. 15, the display device may further include: a timing controller 501, a source driver 502, a gate driver 503, a data memory 504, and the like. The chroma compensation device according to the embodiment of the present disclosure may be disposed in the timing controller 501, the gate driver 503 and the display panel 505 are connected by a gate line (GL), the source driver 502 and the display panel 505 are connected by a data line (DL), and the display panel 505 is also loaded with a power signal EL (for example, an anode signal and a cathode signal).

The timing controller 501 is configured to read first color data stored in the data memory 504 (for example, initial colors or color coordinates of respective display sub-pixels), and receive second color data of respective display sub-pixels that are inputted externally, and receive a timing control signal. For example, the second color data may be data of colors that need to be displayed by the R sub-pixel, the G sub-pixel, and the B sub-pixel in the application scenario, or the second color data may be data of a target color that needs to be displayed by the target pixel unit in the application scenario. After performing the calculation, conversion and compensation on respective signals and data, the timing controller 501 may generate a data signal, a source control signal (SCS), and a gate control signal (GCS), and send the date signal and the SCS to the source driver 502 and the GCS to the gate driver 503.

Figure 16:
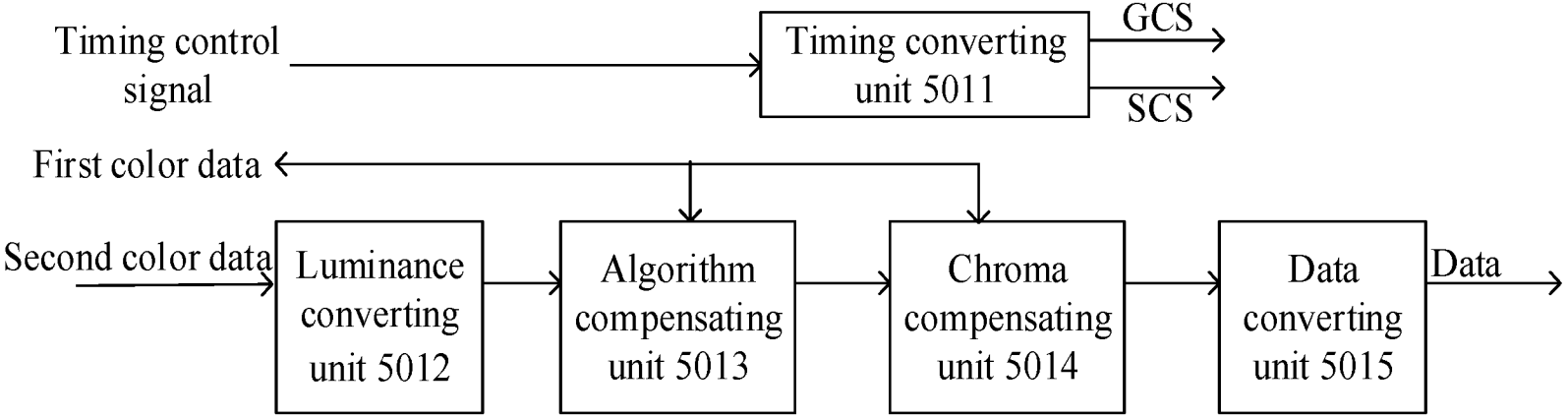
FIG. 16 is a schematic structural diagram of a timing controller according to an embodiment of the present disclosure.

Referring to FIG. 16, the timing controller 501 includes: a timing converting unit 5011, a luminance converting unit 5012, an algorithm compensating unit 5013, a chroma compensating unit 5014, and a data converting unit 5015. The chroma compensating unit 5014 is provided with the chroma compensation apparatus according to the embodiment of the present disclosure, and the timing converting unit 5011 is configured to receive the timing control signal and generate the SCS and the GCS; and the luminance converting unit 5012 is configured to receive the second color data of respective display sub-pixels that are inputted externally, and convert the data into the luminance signals of respective display sub-pixels and send the luminance signals to the algorithm compensation unit 5013; upon receiving the luminance signals sent by the luminance converting unit 5012, the algorithm compensating unit 5013 may compensate for the luminance signals according to the compensation algorithms such as RGB-RGBW algorithm, peak luminance algorithm, drive TFT characteristic value compensation, OLED characteristic value compensation and optical compensation, and send the compensated luminance signals to the chroma compensating unit 5014; the chroma compensating unit 5014 may perform chrominance compensation on the color coordinates of different pixel units, different colors, and different luminances according to the chroma compensation method according to the embodiment of the present disclosure, to generate a chrominance-compensated luminance signal and send the same to the data converting unit 5015; and the data converting unit 5015 may convert the luminance signal into a grayscale data signal (e.g., a data signal), and send the same to the source driver 502, such that the source driver 502 generates a corresponding drive output signal according to the grayscale data signal and provides the drive output signal for the display sub-pixel to drive the pixel unit to display.

The data memory 504 stores: color coordinate data of different pixels, different colors, and different luminances of the display panel 505; the characteristic values of different drive thin film transistors (TFTs) (for example, the characteristic values such as the threshold voltage Vth and the mobility K of TFT); the characteristic values of different OLED devices (for example, the threshold voltage Voled of OLED); and different TFT characteristic values and optical compensation characteristic values of different OLED devices.

The source driver 502 is configured to receive the data signal and the SCS outputted by the timing controller 501, based on which, generate a source drive voltage, and send the source drive voltage to the display panel 505 through the data line DL; and the gate driver 503 is configured to receive the GCS and generate a gate drive signal according to the GCS, and send the gate drive signal to the display panel 505 through at least one gate line GL.

Figure 17:
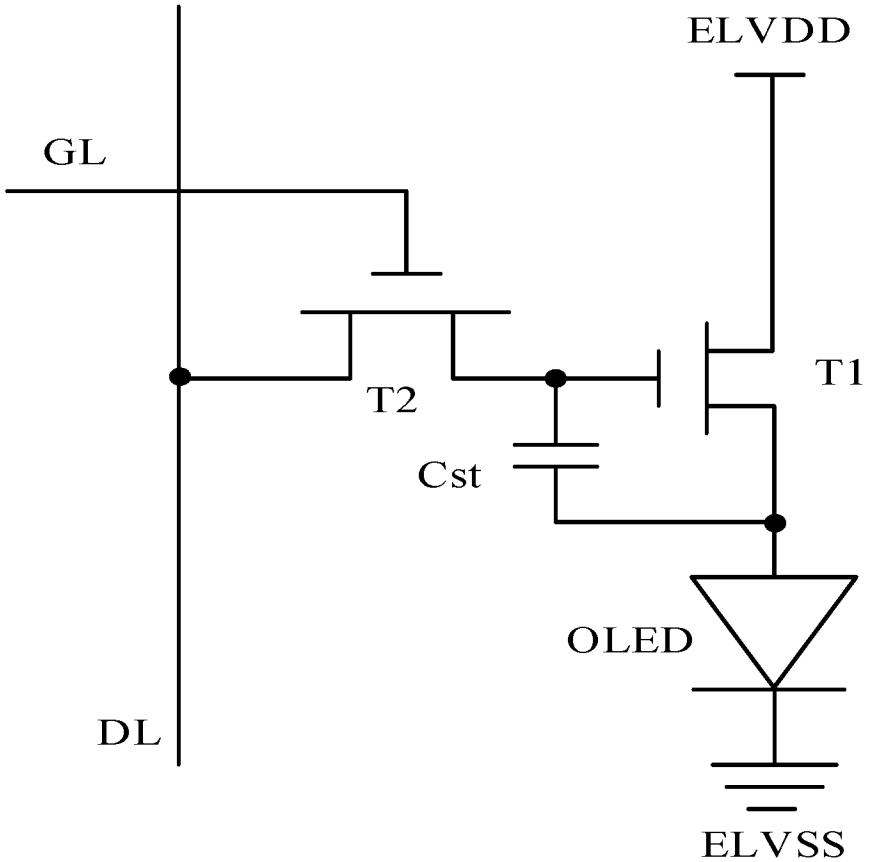
FIG. 17 is a schematic structural diagram of a pixel unit according to an embodiment of the present disclosure.

The display panel 505 includes a plurality of pixel units and a power source that drives the OLED to emit light (e.g., an anode power source ELVDD and a cathode power source ELVSS). Referring to FIG. 17, each pixel unit includes: at least one data line DL, at least one gate line GL, an OLED device, a storage capacitor Cst, a switch TFT T1, a drive TFT T2, an anode power source ELVDD, and a cathode power source ELVSS.

An embodiment of the present disclosure provides a device for use in chroma compensation. The device includes: a processor and a memory. The memory stores at least one program configured to be executed by a processor. The program, when executed by the processor, may cause the processor to perform the chroma compensation method according to the embodiments of the present disclosure.

An embodiment of the present disclosure provides a storage medium, which may be a non-volatile storage medium storing a computer program. The computer program, when being executed by the processor, may cause the processor to perform the chroma compensation method according to the embodiments of the present disclosure.

Understandably, the term "plurality" herein refers to two or more. The word "and/or" herein describes the corresponding relationship of the corresponding objects, indicating three kinds of relationship. For example, A and/or B, may be expressed as: A exists alone, A and B exist concurrently, B exists alone. The character "/" generally indicates that the context object is an "OR" relationship.

Described above are merely preferred embodiments of the present disclosure, and are not intended to limit the present disclosure. Within the spirit and principles of the disclosure, any modifications, equivalent substitutions, or improvements are within the protection scope of the present disclosure.

What is claimed is:

1. A chroma compensation method, comprising:

acquiring an initial color of a display sub-pixel in a target pixel unit under a target luminance, and a target color of the target pixel unit under the target luminance, the target pixel unit comprising: at least two display sub-pixels of different light colors;

acquiring a complementary color gain of each of the display sub-pixels under the target luminance based on the target color and the initial color of each of the display sub-pixels by querying a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of any of the display sub-pixels by which the target pixel unit is compensated from the initial color to the target color under and different luminances; and compensating for chrominance of the target pixel unit based on the complementary color gain of each of the display sub-pixels under the target luminance, wherein the complementary color gain of any of the display sub-pixels under the target luminance is used to represent a degree to which the any of the display sub-pixels needs to be compensated when the color of the target pixel unit is compensated from the initial color to the target color under the target luminance, and wherein querying the corresponding relationship between the luminance and the complementary color gain of any of the display sub-pixels to determine the complementary color gain of any of the display sub-pixels under the target luminance based on the target color and the initial color of any of the display sub-pixels, comprises:

querying the corresponding relationship according to the target luminance; and determining a complementary color gain corresponding to the target luminance as a complementary color gain of any of the display sub-pixels under the target luminance when the target luminance is recorded in the corresponding relationship.

2. The method according to claim 1, wherein, prior to the querying a corresponding relationship between the luminance and the complementary color gain of any of the display sub-pixels to determine the complementary color gain of any of the display sub-pixels under the target luminance based on the target color and the initial color of any of the display sub-pixels, the method further comprises:

acquiring a complementary color gain of each of the display sub-pixels at a plurality of reference luminances based on the target color and the initial color of each of the display sub-pixels; and establishing a corresponding relationship between the luminance and the complementary color gain of each of the display sub-pixels under the target color and the initial color of each of the display sub-pixels.

3. The method according to claim 2, wherein the acquiring a complementary color gain of each of the display sub-pixels comprises:

determining, at a first luminance, a first initial color of the target pixel unit based on an initial color of the at least two display sub-pixels, the first luminance being any one of the plurality of reference luminances;

acquiring, based on the first initial color and the initial color of the at least two display sub-pixels, a first substitution proportion of an initial color of each of the display sub-pixels with respect to the first initial color, the first substitution proportion being a proportion of the initial color of each of the display sub-pixels in the first initial color;

acquiring, based on the target color and the initial color of the at least two display sub-pixels, a second substitution proportion of an initial color of each of the display sub-pixels with respect to the target color, the second substitution proportion being a proportion of the initial color of each of the display sub-pixels in the target color;

determining, based on the first substitution proportion and the second substitution proportion, a first complementary color coefficient of the first initial color under the first luminance and a second complementary color coefficient of the target color under the first luminance respectively, the first complementary color coefficient being used to represent a degree of chrominance compensation that needs to be performed when acquiring the first initial color, and the second complementary color coefficient being used to represent a degree of chrominance compensation that needs to be performed when acquiring the target color; and determining a complementary color gain of each of the display sub-pixels under the first luminance based on the first complementary color coefficient and the second complementary color coefficient.

4. The method according to claim 3, wherein the at least two display sub-pixels comprise a first sub-pixel, a second sub-pixel, and a third sub-pixel; when colors of the sub-pixels are represented by color coordinates, a $j^{th}$ substitution proportion $R_{Wj1}$ corresponding to the first sub-pixel, a $j^{th}$ substitution proportion $R_{Wj2}$ corresponding to the second sub-pixel, and a $j^{th}$ substitution proportion $R_{Wj3}$ corresponding to the third sub-pixel satisfy:

$$R_{Wj1} = \left( \frac{\left( \frac{W_{jX} - R_X}{G_X - R_X} - \frac{W_{jZ} - R_Z}{G_Z - R_Z} \right) \Big/ W_{jY}}{\frac{B_X - R_X}{G_X - R_X} - \frac{B_Z - R_Z}{G_Z - R_Z}} \right) \times R_Y$$

-continued $$R_{Wj2} = \left( \frac{W_{jX} - R_X}{W_{jY} \times (G_X - R_X)} - R_{W11} \times \frac{B_X - R_X}{G_X - R_X} \right) \times G_Y$$

$$R_{Wj3} = \left( \frac{1}{W_{jY}} - R_{W11} - R_{W12} \right) \times B_Y,$$

where j is 1 or 2, the color coordinates of the initial color of the first sub-pixel are ($B_X$, $B_Y$), and the color coordinates of the initial color of the second sub-pixel are ($G_X$, $G_Y$), the color coordinates of the initial color of the third sub-pixel are ($R_X$, $R_Y$), the color coordinates of the first initial color are ($W_{1X}$, $W_{1Y}$), the color coordinates of the target color are ($W_{2X}$, $W_{2Y}$), and $R_Z=1-R_X-R_Y$, $G_Z=1-G_X-G_Y$, $B_Z=1-B_X-B_Y$, $W_{1Z}=1-W_{1X}-W_{1Y}$, $W_{2Z}=1-W_{2X}-W_{2Y}$.

5. The method according to claim 3, wherein when the colors of the sub-pixels are represented by color coordinates, the determining, based on the first substitution proportion and the second substitution proportion, a first complementary color coefficient of the first initial color under the first luminance and a second complementary color coefficient of the target color under the first luminance respectively comprises:

acquiring relative positions of the color coordinates of the first initial color and the target color in a color coordinate system;

determining, based on the relative positions, a dominant color component that causes the first initial color to deviate from the target color, the dominant color component being a color component having the largest proportion in the color component that cause the first initial color to deviate from the target color;

determining the first substitution proportion of a sub-pixel whose light color is the dominant color component as the first complementary color coefficient; and determining the second substitution proportion of a sub-pixel whose light color is the dominant color component as the second complementary color coefficient.

6. The method according to claim 5, wherein the at least two display sub-pixels comprise a first sub-pixel, a second sub-pixel, and a third sub-pixel; and the determining, based on the relative positions, a dominant color component that causes the first initial color to deviate from the target color comprises:

determining the light color of the second sub-pixel as the dominant color component when the color coordinates ($W_{1X}$, $W_{1Y}$) of the first initial color and the color coordinates ($W_{2X}$, $W_{2Y}$) of the target color satisfy: $W_{1Y} \geq W_{2Y}$;

determining the light color of the third sub-pixel as the dominant color component when the color coordinates ($W_{1X}$, $W_{1Y}$) of the first initial color and the color coordinates ($W_{2X}$, $W_{2Y}$) of the target color satisfy: $W_{1X} \geq W_{2X}$ and $W_{1Y} < W_{2Y}$; and determining the light color of the first sub-pixel as the dominant color component when the color coordinates ($W_{1X}$, $W_{1Y}$) of the first initial color and the color coordinates ($W_{2X}$, $W_{2Y}$) of the target color satisfy: $W_{1X} < W_{2X}$ and $W_{1Y} < W_{2Y}$.

7. The method according to claim 3, wherein the first complementary color coefficient $R_{W1}$, the second complementary color coefficient $R_{W2}$, and the complementary color gain $G_i$ of an $i^{th}$ sub-pixel under the first luminance satisfy:

$$G_i = \left( 1 - \frac{\frac{R_{W2i}}{R_{W2}} - \frac{R_{W1i}}{R_{W1}}}{\frac{R_{W2i}}{R_{W2}}} \right) \times (2^n - 1),$$

where $R_{W2i}$ is a second substitution proportion corresponding to the $i^{th}$ sub-pixel, the $R_{W1i}$ is a first substitution proportion corresponding to the $i^{th}$ sub-pixel, n is the number of bits of the drive output signal provided for the sub-pixel, and the drive output signal is used to drive the sub-pixel to emit light.

8. The method according to claim 1, wherein the querying a corresponding relationship between the luminance and the complementary color gain of any of the display sub-pixels to determine the complementary color gain of any of the display sub-pixels under the target luminance based on the target color and the initial color of any of the display sub-pixels, further comprises:

determining a first candidate luminance and a second candidate luminance among the plurality of luminances recorded in the corresponding relationship when the target luminance is not recorded in the corresponding relationship, the first candidate luminance being one of the plurality of luminances that is weaker than the target luminance and has a smallest luminance difference over the target luminance, the second candidate luminance being one of the plurality of luminances that is stronger than the target luminance and has the smallest luminance difference over the target luminance; and determining the complementary color gain of any of the display sub-pixels under the target luminance according to a linear interpolation method, based on the target luminance, the first candidate luminance, the second candidate luminance, the complementary color gain corresponding to the first candidate luminance, and the complementary color gain corresponding to the second candidate luminance.

9. The method according to claim 1, wherein the compensating for chrominance of the target pixel unit based on the complementary color gain of each of the display sub-pixels under the target luminance comprises:

determining a drive output signal provided for any of the display sub-pixels based on a complementary color gain of any of the display sub-pixels under the target luminance, the drive output signal being configured for driving the sub-pixel to emit light; and providing the drive output signal to any of the display sub-pixels for compensating for chrominance of the target pixel unit.

10. A chroma compensation apparatus, comprising:

a processor; and a memory;

wherein the memory stores at least one program configured to be executed by the processor, wherein the program, when being executed by the processor, causes the processor to perform a chroma compensation method comprising:

acquiring an initial color of a display sub-pixel in a target pixel unit at a target luminance, and a target color of the target pixel unit under the target luminance, the target pixel unit comprising: at least two display sub-pixels of different light colors;

acquiring a complementary color gain of each of the display sub-pixels under the target luminance based on the target color and an initial color of each of the display sub-pixels by querying a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of any of the display sub-pixels by which the target pixel unit is compensated from the initial color to the target color under and different luminances; and compensating for chrominance of the target pixel unit based on a complementary color gain of each of the display sub-pixels under the target luminance, wherein the complementary color gain of any of the display sub-pixels under the target luminance is used to represent a degree to which the any of the display sub-pixels needs to be compensated when the color of the target pixel unit is compensated from the initial color to the target color under the target luminance, and wherein querying the corresponding relationship between the luminance and the complementary color gain of any of the display sub-pixels to determine the complementary color gain of any of the display sub-pixels under the target luminance based on the target color and the initial color of any of the display sub-pixels, comprises:

querying the corresponding relationship according to the target luminance; and determining a complementary color gain corresponding to the target luminance as a complementary color gain of any of the display sub-pixels under the target luminance when the target luminance is recorded in the corresponding relationship.

11. The apparatus according to claim 10, wherein the chroma compensation method performed by the processor further comprises:

acquiring a complementary color gain of each of the display sub-pixels at a plurality of reference luminances based on the target color and the initial color of each of the display sub-pixels; and to establishing a corresponding relationship between the luminance and the complementary color gain of each of the display sub-pixels under the target color and the initial color of each of the display sub-pixels.

12. The apparatus according to claim 11, wherein the acquiring a complementary color gain of each of the display sub-pixels comprises:

determining, at a first luminance, a first initial color of the target pixel unit based on an initial color of the at least two display sub-pixels, the first luminance being any one of the plurality of reference luminances;

acquiring, based on the first initial color and the initial color of the at least two display sub-pixels, a first substitution proportion of an initial color of each of the display sub-pixels with respect to the first initial color, the first substitution proportion being a proportion of the initial color of each of the display sub-pixels in the first initial color;

acquiring, based on the target color and an initial color of the at least two display sub-pixels, a second substitution proportion of an initial color of each of the display sub-pixels with respect to the target color, the second substitution proportion being a proportion of the initial color of each of the display sub-pixels in the target color;

determining, based on the first substitution proportion and the second substitution proportion, a first complementary color coefficient of the first initial color under the first luminance and a second complementary color coefficient of the target color under the first luminance respectively, the first complementary color coefficient being used to represent a degree of chrominance compensation that needs to be performed when acquiring the first initial color, and the second complementary color coefficient being used to represent a degree of chrominance compensation that needs to be performed when acquiring the target color;

determining a complementary color gain of each of the display sub-pixels under the first luminance based on the first complementary color coefficient and the second complementary color coefficient.

13. The apparatus according to claim 12, wherein the at least two display sub-pixels comprise a first sub-pixel, a second sub-pixel, and a third sub-pixel; when colors of the sub-pixels are represented by color coordinates, a $j^{th}$ substitution proportion $R_{Wj1}$ corresponding to the first sub-pixel, a $j^{th}$ substitution proportion $R_{Wj2}$ corresponding to the second sub-pixel, and a $j_{th}$ substitution proportion $R_{Wj3}$ corresponding to the third sub-pixel satisfy:

$$R_{Wj1} = \left( \frac{\left( \frac{W_{jX} - R_X}{G_X - R_X} - \frac{W_{jZ} - R_Z}{G_Z - R_Z} \right) \Big/ W_{jY}}{\frac{B_X - R_X}{G_X - R_X} - \frac{B_Z - R_Z}{G_Z - R_Z}} \right) \times R_Y$$

$$R_{Wj2} = \left( \frac{W_{jX} - R_X}{W_{jY} \times (G_X - R_X)} - R_{W11} \times \frac{B_X - R_X}{G_X - R_X} \right) \times G_Y$$

$$R_{Wj3} = \left( \frac{1}{W_{jY}} - R_{W11} - R_{W12} \right) \times B_Y,$$

where j is 1 or 2, the color coordinates of an initial color of the first sub-pixel are $(B_X, B_Y)$, the color coordinates of an initial color of the second sub-pixel are $(G_X, G_Y)$, the color coordinates of an initial color of the third sub-pixel are $(R_X, R_Y)$, the color coordinates of the first initial color are $(W_{1X}, W_{1Y})$, the color coordinates of the target color are $(W_{2X}, W_{2Y})$, and $R_Z=1-R_X-R_Y$, $G_Z=1-G_X-G_Y$, $B_Z=1-B_X-B_Y$, $W_{2Z}=1-W_{2X}-W_{2Y}$.

14. The apparatus according to claim 12, wherein when the colors of the sub-pixels are represented by color coordinates, the determining, based on the first substitution proportion and the second substitution proportion, a first complementary color coefficient of the first initial color under the first luminance and a second complementary color coefficient of the target color under the first luminance respectively comprises:

acquiring relative positions of the color coordinates of the first initial color and the target color in a color coordinate system;

determining, based on the relative positions, a dominant color component that causes the first initial color to deviate from the target color, the dominant color component being a color component having the largest proportion in the color component that cause the first initial color to deviate from the target color;

determining the first substitution proportion of a sub-pixel whose light color is the dominant color component as the first complementary color coefficient; and determining the second substitution proportion of a sub-pixel whose light color is the dominant color component as the second complementary color coefficient.

15. The apparatus according to claim 14, wherein the at least two display sub-pixels comprise a first sub-pixel, a second sub-pixel, and a third sub-pixel; and the determining, based on the relative positions, a dominant color component that causes the first initial color to deviate from the target color comprises:

determining the light color of the second sub-pixel as the dominant color component when the color coordinates ($W_{1X}$, $W_{1Y}$) of the first initial color and the color coordinates ($W_{2X}$, $W_{2Y}$) of the target color satisfy: $W_{1Y} \geq W_{2Y}$;

determining the light color of the third sub-pixel as the dominant color component when the color coordinates ($W_{1X}$, $W_{1Y}$) of the first initial color and the color coordinates ($W_{2X}$, $W_{2Y}$) of the target color satisfy: $W_{1X} \geq W_{2X}$ and $W_{1Y} < W_{2Y}$; and determining the light color of the first sub-pixel as the dominant color component when the color coordinates ($W_{1X}$, $W_{1Y}$) of the first initial color and the color coordinates ($W_{2X}$, $W_{2Y}$) of the target color satisfy: $W_{1X} < W_{2X}$ and $W_{1Y} < W_{2Y}$.

16. The apparatus according to claim 12, wherein the first complementary color coefficient $R_{W1}$, the second complementary color coefficient $R_{W2}$, and the complementary color gain $G_i$ of an $i^{th}$ sub-pixel under the first luminance satisfy:

$$G_i = \left(1 - \frac{\frac{R_{W2i}}{R_{W2}} - \frac{R_{W1i}}{R_{W1}}}{\frac{R_{W2i}}{R_{W2}}}\right) \times (2^n - 1),$$

where $R_{W2i}$ is a second substitution proportion corresponding to the $i^{th}$ sub-pixel, the $R_{W1i}$ is a first substitution proportion corresponding to the $i^{th}$ sub-pixel, n is the number of bits of the drive output signal provided for the sub-pixel, and the drive output signal is used to drive the sub-pixel to emit light.

17. A display device, comprising the chroma compensation apparatus as defined in claim 10.

18. The apparatus according to claim 10, wherein the chroma compensation method performed by the processor further comprises:

determining a first candidate luminance and a second candidate luminance among the plurality of luminances recorded in the corresponding relationship when the target luminance is not recorded in the corresponding relationship, the first candidate luminance being one of the plurality of luminances that is weaker than the target luminance and has a smallest luminance difference over the target luminance, the second candidate luminance being one of the plurality of luminances that is stronger than the target luminance and has the smallest luminance difference over the target luminance; and determining the complementary color gain of any of the display sub-pixels under the target luminance according to a linear interpolation method, based on the target luminance, the first candidate luminance, the second candidate luminance, the complementary color gain corresponding to the first candidate luminance, and the complementary color gain corresponding to the second candidate luminance.

19. A non-transitory storage medium having stored therein a computer program, wherein the computer program, when being executed by a processor, causes the processor to perform a chroma compensation method comprising:

acquiring an initial color of a display sub-pixel in a target pixel unit under a target luminance, and a target color of the target pixel unit under the target luminance, the target pixel unit comprising: at least two display sub-pixels of different light colors;

acquiring a complementary color gain of each of the display sub-pixels under the target luminance based on the target color and the initial color of each of the display sub-pixels by querying a corresponding relationship between the luminance and the complementary color gain of any of the display sub-pixels to determine the complementary color gain of any of the display sub-pixels under the target luminance based on the target color and the initial color of any of the display sub-pixels, the corresponding relationship recording the complementary color gain of any of the display sub-pixels by which the target pixel unit is compensated from the initial color to the target color under and different luminances; and compensating for chrominance of the target pixel unit based on the complementary color gain of each of the display sub-pixels under the target luminance, wherein the complementary color gain of any of the display sub-pixels under the target luminance is used to represent a degree to which the any of the display sub-pixels needs to be compensated when the color of the target pixel unit is compensated from the initial color to the target color under the target luminance, and wherein querying the corresponding relationship between the luminance and the complementary color gain of any of the display sub-pixels to determine the complementary color gain of any of the display sub-pixels under the target luminance based on the target color and the initial color of any of the display sub-pixels, comprises:

querying the corresponding relationship according to the target luminance; and determining a complementary color gain corresponding to the target luminance as a complementary color gain of any of the display sub-pixels under the target luminance when the target luminance is recorded in the corresponding relationship.

20. The storage medium according to claim 19, wherein the chroma compensation method performed by the processor further comprises:

determining a first candidate luminance and a second candidate luminance among the plurality of luminances recorded in the corresponding relationship when the target luminance is not recorded in the corresponding relationship, the first candidate luminance being one of the plurality of luminances that is weaker than the target luminance and has a smallest luminance difference over the target luminance, the second candidate luminance being one of the plurality of luminances that is stronger than the target luminance and has the smallest luminance difference over the target luminance; and determining the complementary color gain of any of the display sub-pixels under the target luminance according to a linear interpolation method, based on the target luminance, the first candidate luminance, the second candidate luminance, the complementary color gain corresponding to the first candidate luminance, and the complementary color gain corresponding to the second candidate luminance.

* * * * *